US006773298B2

(12) United States Patent
Gutierrez et al.

(10) Patent No.: US 6,773,298 B2
(45) Date of Patent: Aug. 10, 2004

(54) CONNECTOR ASSEMBLY WITH LIGHT SOURCE SUB-ASSEMBLIES AND METHOD OF MANUFACTURING

(75) Inventors: Aurelio J. Gutierrez, Bonita, CA (US); Tsou Zheng Rong, Jungli (TW)

(73) Assignees: Pulse Engineering, Inc., San Diego, CA (US); Full Rise Electronics Co., Ltd., Taoyuan (TW)

( * ) Notice: Subject to any disclaimer, the term of this patent is extended or adjusted under 35 U.S.C. 154(b) by 0 days.

(21) Appl. No.: 10/140,422

(22) Filed: May 6, 2002

(65) Prior Publication Data

US 2003/0207622 A1 Nov. 6, 2003

(51) Int. Cl.[7] ..... H01R 3/00
(52) U.S. Cl. ..... 439/490; 439/676
(58) Field of Search ..... 439/490, 696, 439/676, 620

(56) References Cited

U.S. PATENT DOCUMENTS

| | | | | |
|---|---|---|---|---|
| 4,978,317 A | | 12/1990 | Pocrass | 439/490 |
| 5,613,873 A | | 3/1997 | Bell, Jr. | 439/490 |
| 5,700,157 A | * | 12/1997 | Chung | 439/490 |
| 5,885,100 A | | 3/1999 | Talend et al. | 439/490 |
| 6,062,908 A | | 5/2000 | Jones | 439/620 |
| 6,120,318 A | * | 9/2000 | Reed et al. | 439/490 |
| 6,162,089 A | | 12/2000 | Costello et al. | 439/541.5 |
| 6,174,194 B1 | * | 1/2001 | Bleicher et al. | 439/490 |
| 6,227,911 B1 | | 5/2001 | Boutros et al. | 439/620 |
| 6,328,595 B1 | * | 12/2001 | Chang | 439/490 |
| 6,375,514 B1 | * | 4/2002 | Chih et al. | 439/676 |
| 6,428,361 B1 | | 8/2002 | Imschweiler et al. | 439/676 |
| 6,431,906 B1 | * | 8/2002 | Belopolsky | 439/490 |
| 6,454,595 B1 | | 9/2002 | Espenshade | 439/490 |
| 6,457,993 B1 | | 10/2002 | Espenshade | 439/490 |
| 6,474,999 B1 | * | 11/2002 | Givens et al. | 439/76.1 |
| 6,478,611 B1 | * | 11/2002 | Hyland | 439/490 |

* cited by examiner

*Primary Examiner*—Tulsidas C. Patel
(74) *Attorney, Agent, or Firm*—Gazdzinski & Associates

(57) ABSTRACT

An improved connector assembly for use on, inter alia, a printed circuit board or other device is disclosed. The assembly comprises a connector housing having one or more modular plug recesses for receiving a modular plug such as an RJ-type plug; a plurality of conductors disposed within the recess for contact with the terminals of the modular plug; and an electrical pathway between the conductors and a corresponding set of circuit board leads. The connector assembly also includes at least one other recess for receiving a light source sub-assembly. Each light source sub-assembly provides one or more light sources (e.g., light-emitting diodes) adapted to permit viewing of status indications during operation. Each light source sub-assembly is constructed to substantially reduce electromagnetic coupling between the light source and the connector's signal paths. The light source sub-assembly further simplifies the manufacturing of the connector assembly.

20 Claims, 17 Drawing Sheets

(1 OF 3)

(2 OF 3)

(3 OF 3)

CONNECTOR ASSEMBLY WITH LIGHT SOURCE SUB-ASSEMBLIES AND METHOD OF MANUFACTURING

BACKGROUND OF THE INVENTION

1. Field of the Invention

The present invention relates generally to miniature electronic elements and particularly to an improved design and method of manufacturing for a single- or multi-port connector assembly having visual status indication capabilities.

2. Description of Related Technology

Modular connectors, such as for example those of the "RJ" configuration, are well known in the electronics industry. Such connectors are adapted to receive one or more modular plugs of varying type (e.g., RJ-45 or RJ-11), and communicate signals between the terminals of the modular plug and the parent device with which the connector is associated. Commonly, some form of signal conditioning (e.g., filtering, voltage transformation, or the like) is performed by the connector on the signals passing through it. Additionally, such connectors often include visual indicators for providing the user/operator with a visual representation of the electrical status of the connector. Such visual indicators may include, for example, light-emitting diodes (LEDs) which emit visible light at one or more wavelengths, such as one "green" LED and one "yellow" LED.

Many different considerations are involved with producing an effective and economically viable connector design. Such considerations include, for example: (i) volume and "footprint" available for the connector; (ii) the need for electrical status indicators (e.g., LEDs); (iii) the cost and complexity associated with assembling and manufacturing the device; (iv) the ability to accommodate various electrical components and signal conditioning configurations; (v) the electrical and noise performance of the device; (vi) the reliability of the device; (vii) the ability to modify the design to accommodate complementary technologies; (viii) compatibility with existing terminal and "pin out" standards and applications; (ix) ability to configure the connector as one of a plurality of ports, potentially having individually variant internal component configurations, and (ix) potentially the replacement of defective components. Additionally, in those designs requiring visual indicators, the presence of the indicators can has significant implications for the rest of the connector design. For example, certain types of visual indicator arrangements may preclude certain internal component configurations, adversely affect connector electrical performance due to radiated EMI, etc.

A variety of different approaches have heretofore been used to provide visual indication of electrical status within modular connectors. See for example, the approach disclosed in U.S. Pat. No. 4,978,317 to Pocrass (hereinafter "Pocrass"), wherein a plurality of LEDs are disposed within recesses formed in the front of the connector housing. The LED conductors in the Pocrass design are run backward through the connector and then downward to the substrate (i.e., PCB), along the top and back walls of the connector. This design suffers from several disabilities, including for example (i) the use of LEDs with comparatively long electrodes, thereby increasing the potential for radiated EMI from the LEDs which can reduce connector electrical performance; (ii) complex molding techniques to produce the needed passages for the LED electrodes; and (iii) the need for individualized insertion of each LED, thereby increasing labor cost. The approach of Pocrass also does not permit ready removal of the LEDs once inserted within the connector, since the electrodes must be deformed again after initial deformation to permit removal.

Additionally, the design of Pocrass is not well adapted to instances where the LED electrodes terminate to the substrate near the forward wall of the connector, since there is no convenient way of routing the electrodes from the LED to the substrate within the connector without taking a circuitous route or displacing other components.

Aside from Pocrass, other approaches to providing visual indicators have been used, such as mounting the LED directly to the substrate, and using either a light pipe or prismatic element to route the LED light to the front face of the connector. These approaches generally suffer from the disability of higher cost and complexity, since not only must the LED be placed and electrically bonded to the substrate, but a complementary light pipe or prism must be manufactured and disposed within the connector housing so as to cooperate with the LED. Such light pipe arrangements also tend to suffer from reduced luminosity as compared to "direct-view" light sources such as the forward-facing LEDs previously described. Additionally, as with Pocrass, individual treatment of each LED/light pipe/prism is again required, thereby increasing manufacturing cost.

Based on the foregoing, it would be most desirable to provide an improved apparatus for providing visual indication in an electrical connector (e.g., modular connector) and method of manufacturing the same. Such improved apparatus would ideally be cost and labor efficient to manufacture, reduce or mitigate radiated EMI as compared to prior art solutions, economize on space within and the footprint of the connector, and allow for the insertion of multiple light sources within the connector assembly at once, thereby reducing labor cost. Furthermore, such improved apparatus would be compatible with most any internal connector configuration, thereby providing the designer with the maximum degree of flexibility in choosing connector internals and indicator combinations.

SUMMARY OF THE INVENTION

The present invention satisfies the aforementioned needs by an improved apparatus and method for providing visual status indication in an electrical connector assembly.

In a first aspect of the invention, an improved light source sub-assembly for use in a connector assembly is disclosed. The light source sub-assembly generally comprises at least one light source (e.g., LED) and a carrier element adapted to physically receive and carry the light source(s). The light source further comprises a plurality of electrodes which are configured such that the light source is disposed in a desired orientation with respect to the connector housing. As such, the light source sub-assembly is inserted into a corresponding recess formed generally in the frontal area of the connector housing, and the light source is oriented within the connector assembly such that the light source can be viewed from the desired location (e.g., front face of the connector housing). The electrodes of the light source are routed directly downward to the substrate or external device to which the connector is mounted, thereby minimizing electrode run length (and EMI generated thereby). In one embodiment, the sub-assembly comprises a single carrier molded around the electrodes of a single LED, the LED and carrier being adapted for use as "end" indicators in a single-or multi-port connector assembly. In a second embodiment, the sub-assembly comprises a single carrier with two LEDs arranged in juxtaposed configuration and adapted for use in the interstitial regions between two adjacent ports in a multi-port connector. This dual-LED arrangement not only conserves space within the connector, but also permits insertion of two LEDs simultaneously, thereby simplifying manufacture.

In a second aspect of the invention, an improved connector assembly for use on, inter alia, a printed circuit board or other device is disclosed. In one exemplary embodiment, the assembly comprises a connector housing having one or more ports (i.e., modular plug recesses such as for receiving RJ-type plugs), a plurality of conductors disposed within the recess for contact with the terminals of the modular plug, and an electrical pathway between the conductors and a corresponding set of circuit board contacts. The improved connector assembly also includes at least one other recess for receiving a corresponding light source sub-assembly of the type described above. Each light source sub-assembly is constructed to substantially reduce electromagnetic coupling between the light source and the connector's signal paths, thereby reducing the amount of noise introduced by the operation of the light source(s).

In one exemplary embodiment, the connector assembly comprises a single modular plug recess (port) having two light sources (e.g., LEDs) disposed relative to the recess and adjacent to the modular plug latch formed therein, such that the LEDs are readily viewable from the front of the connector assembly. In this embodiment, the connector assembly also comprises two recesses for receiving two light source sub-assemblies, with each sub-assembly comprising one light source. The LED electrodes (two per LED) are routed through the light source sub-assembly so that when the sub-assembly is inserted into the sub-assembly recess, the LED electrodes mate with respective contact points on the circuit board or other external device to which the connector assembly is mounted.

In a second exemplary embodiment, the connector assembly comprises a single row, multi-port connector housing having a plurality of plug recesses arranged in a side-by-side orientation. Associated with each plug recess are two light sources. Three light source sub-assemblies having different constructions (i.e., two effectively "mirror imaged" end sub-assemblies and one or more interstitial multi-light source sub-assemblies) are inserted into corresponding recesses formed in the housing in order to provide a pair of status indicators per plug port.

In yet another embodiment, the connector assembly comprises a multi-row, multi-port device having unitary light source sub-assemblies associated with each column of ports.

In a third aspect of the invention, an improved electronic assembly utilizing the aforementioned connector assembly is disclosed. In one exemplary embodiment, the electronic assembly comprises the foregoing multi-port connector which is mounted to a printed circuit board (PCB) substrate having a plurality of conductive traces formed thereon, and bonded thereto using a soldering process, thereby forming a conductive pathway from the traces through the conductors of the respective ports of the connector. In another embodiment, the connector assembly is mounted on an intermediary substrate, the latter being mounted to a PCB or other component using a reduced footprint terminal array.

In a fourth aspect of the invention, an improved method of manufacturing a light source assembly is disclosed. The method generally comprises: providing a first light source and a second light source each having a viewing surface and a plurality of electrodes associated therewith; deforming the electrodes of the first light source into a first configuration; deforming the electrodes of the second light source into a second configuration; disposing the first and second light sources such that the viewing surfaces of the light sources are juxtaposed; and forming at least one carrier element around at least a portion of the electrodes of the first and second light sources.

In a fifth aspect of the present invention, an improved method of manufacturing the connector assembly of the present invention is disclosed. The method generally comprises: forming a connector housing having a front face, at least one modular jack port and a first and second recess each formed at least partly in the front face; providing first and second light sources having a viewing surface and a plurality of electrodes; deforming the electrodes of the first light source into a first configuration such that the light source can be received within the first recess with the viewing surface being viewable from the front face of the housing; deforming the electrodes of the second light source into a second configuration such that the light source can be received within the second recess with the viewing surfaces being viewable from the front face of the housing; inserting the first light source into the first recess, the electrodes of the first light source being positioned to mate with an external device; and inserting the second light source into the second recess, the electrodes of the second light source being positioned to mate with the external device.

BRIEF DESCRIPTION OF THE DRAWINGS

The features, objectives, and advantages of the invention will become more apparent from the detailed description set forth below when taken in conjunction with the drawings, wherein.

DETAILED DESCRIPTION OF THE PREFERRED EMBODIMENT

Reference is now made to the drawings wherein like numerals refer to like parts throughout.

It is noted that while the following description is cast primarily in terms of RJ-type connectors and associated modular plugs of the type well known in the art, the present invention may be used in conjunction with any number of different connector types. Accordingly, the following discussion of the RJ connectors and plugs is merely exemplary of the broader concepts.

Also, it is noted that while the following description is cast primarily in terms of light-emitting diodes (LEDs) of the type well known in the art, the present invention may be used in conjunction with any number of different light source types, as described in greater detail below. Accordingly, the discussion of LEDs in various embodiments is merely exemplary of the broader invention utilizing light sources of varying types.

As used herein, the terms "electrical component" and "electronic component" are used interchangeably and refer to components adapted to provide some electrical function, including without limitation inductive reactors ("choke coils"), transformers, filters, gapped core toroids, inductors, capacitors, resistors, operational amplifiers, and diodes, whether discrete components or integrated circuits, whether alone or in combination. For example, the improved toroidal device disclosed in co-Assignee's co-pending U.S. patent application Ser. No. 09/661,628 entitled "Advanced Electronic Microminiature Coil and Method of Manufacturing" filed Sep. 13, 2000, which is incorporated herein by reference in its entirety, may be used in conjunction with the invention disclosed herein.

Furthermore, so called "interlock base" assemblies such as those manufactured by the Assignee hereof and described in detail in, inter alia, U.S. Pat. No. 5,015,981 entitled "Electronic Microminiature Packaging and Method", issued May 14, 1991, and incorporated by reference herein in its entirety, may be used.

Similarly, the term "signal conditioning" or "conditioning" shall be understood to include, but not be limited to, signal voltage transformation, filtering and noise mitigation, signal splitting, impedance control and correction, current limiting, capacitance control, and time delay.

Single-Port Embodiment

Figure 1A:
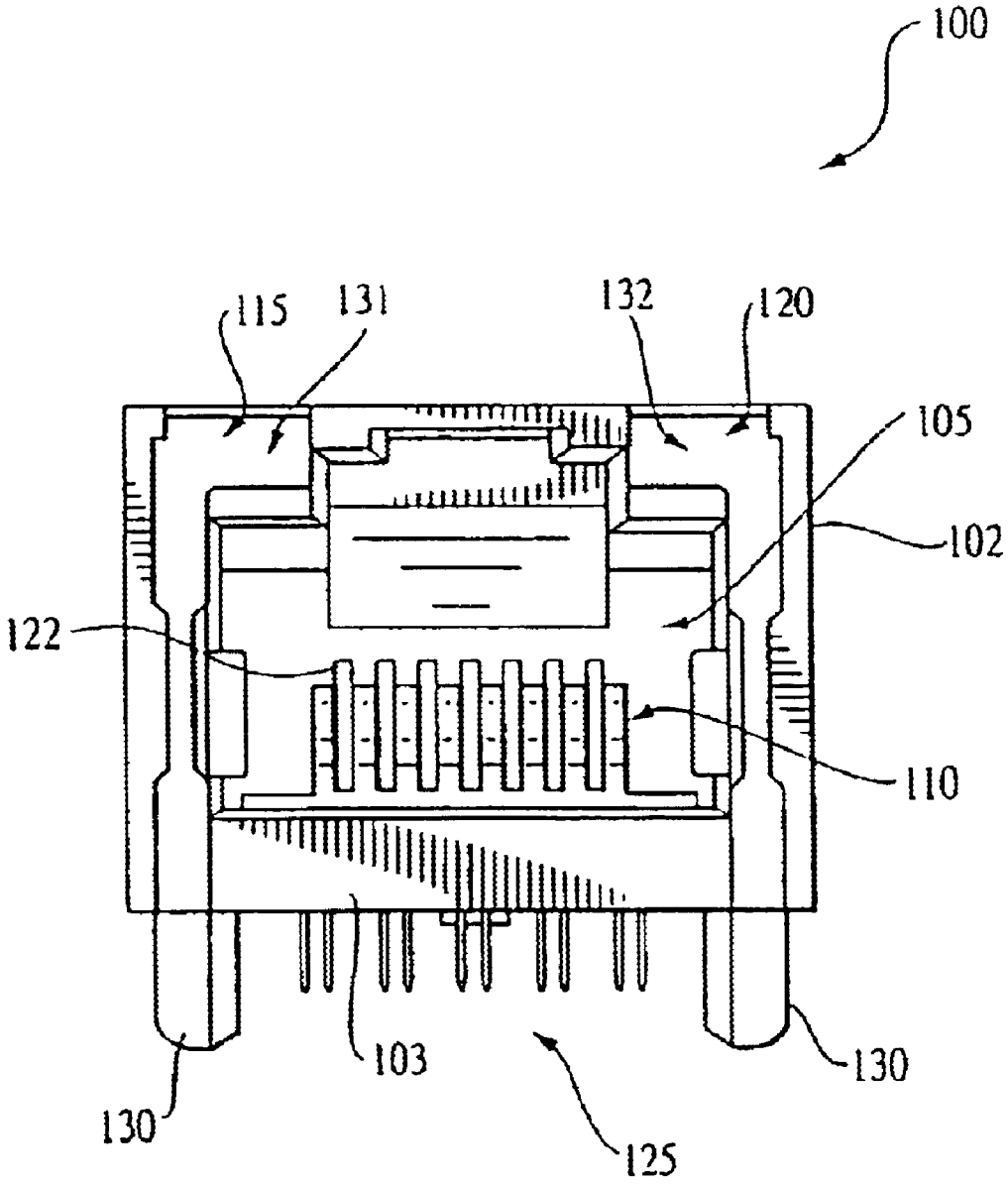
FIG. 1*a* is a front plan view of an exemplary single port embodiment of the connector assembly housing according to the present invention.
Figure 1B:
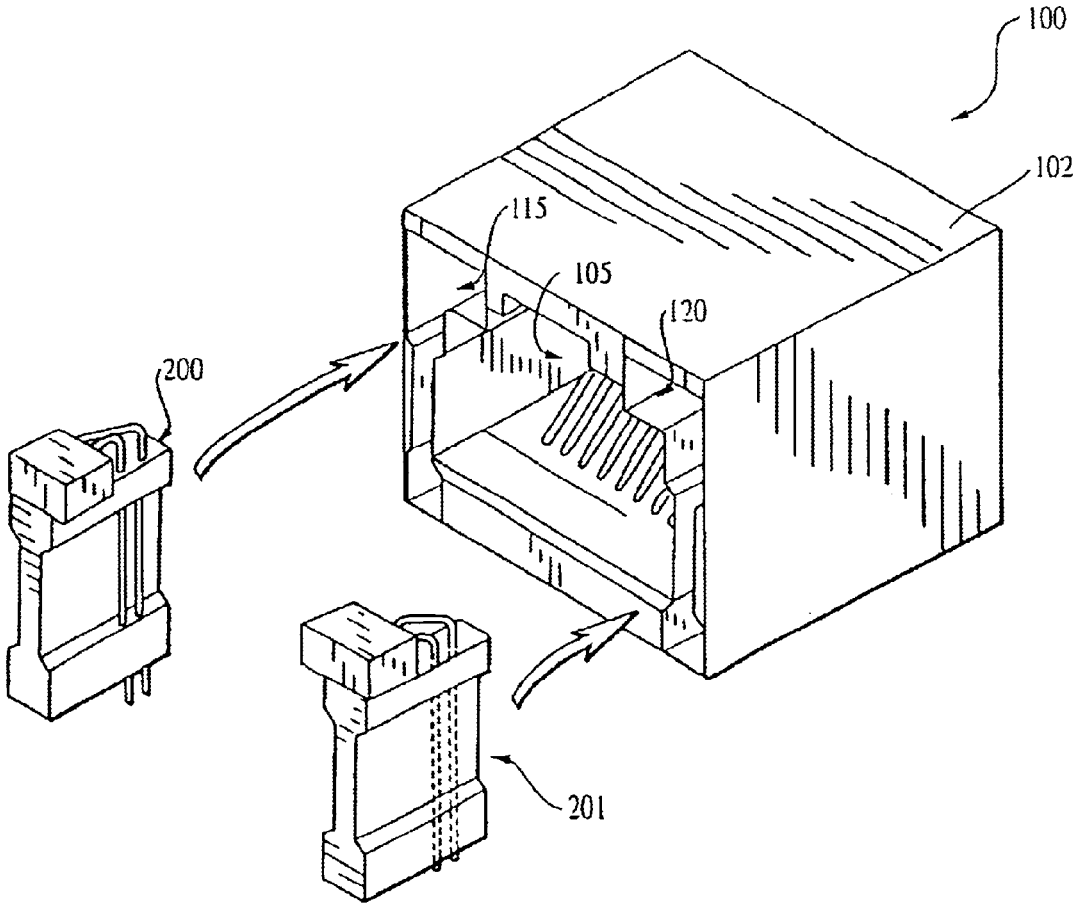
FIG. 1*b* is a perspective assembly view of the connector assembly of FIG. 1*a,* illustrating the light source sub-assemblies.
Figure 1C:
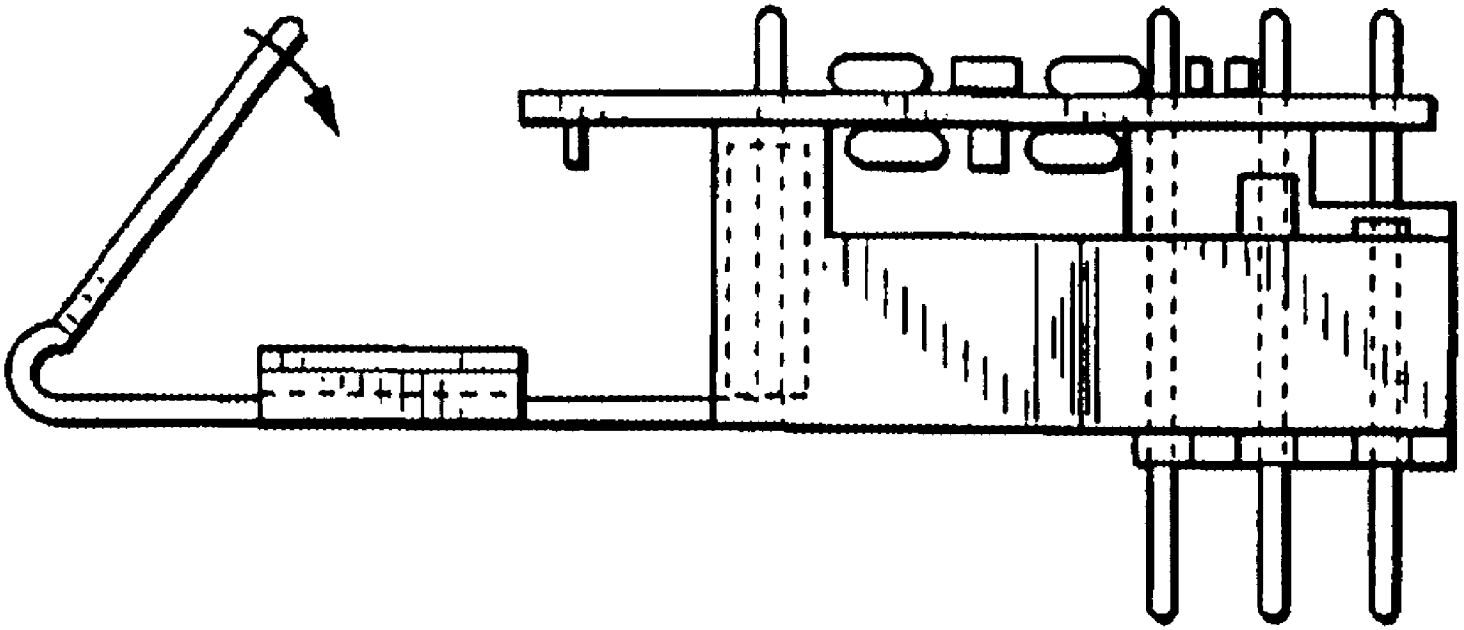
FIG. 1*c* is a sidef plan view of a first exemplary connector internal configuration which may be used in conjunction with the present invention.

Referring now to FIGS. 1*a* and 1*b*, a first embodiment of the connector assembly of the present invention is described. As shown in FIG. 1*a*, an assembly 100 generally comprises a connector-housing element 102 having a single modular plug-receiving connector recess 105 formed therein. The front wall 103 of the connector housing element 102 is preferably disposed generally perpendicular or orthogonal to a PCB surface (or other device) to which the connector assembly 100 is mounted, with a latch mechanism located away from the PCB, such that a modular plug may be inserted into the plug recess 105 formed in the connector housing 102 without physical interference with the PCB. The plug recess 105 is adapted to receive one modular plug (not shown) having a plurality of electrical conductors disposed therein in a predetermined array, the array being so adapted to mate with a set of respective conductors 110 present in the recesses 105 thereby forming an electrical connection between the plug conductors and connector conductors 110. The conductors 110 are coupled to an electrical pathway that leads to a PCB mating array 125 for electrically coupling the connectors 110 to the PCB. A pair of connector posts 130 is also supplied for PCB connection. The connector housing element 102 in the illustrative embodiment is electrically non-conductive and is formed from a thermoplastic (e.g. PCT Thermex, IR compatible, UL94V-0), although it will recognized that other materials, polymer or otherwise, may conceivably be used. An injection molding process is used to form the housing element 102, although other processes (such as for example transfer molding) may be used, depending on the material chosen. The selection and manufacture of the housing element is well understood in the art, and accordingly will not be described further herein.

The connector housing element 102 also includes one or more modular recesses, each for receiving a light source sub-assemblies 200, 201. The construction and operation of the light source sub-assemblies 200, 201 of the invention are described in detail below with respect to FIGS. 2*a*–2*b*. In the exemplary embodiment 100, the housing element 102 includes a left-side light source sub-assembly recess 115 and a right-side light source sub-assembly recess 120, which are adapted to receive the two sub-assemblies 200, 201, respectively. In the illustrated embodiment 100 of FIG. 1*a*, the right-side and left-side light source sub-assembly recesses are substantially symmetrical (i.e., "mirror imaged") with respect to one another; however, it will be recognized that such "mirror-image" symmetry is not required to practice the present invention.

The sub assembly recesses 115, 120 of the connector housing 102 in the illustrated embodiment are shaped to accommodate respective ones of the aforementioned light source sub-assemblies 200, 201 therein, such that the light source front surfaces 207 (FIG. 2*a*) are flush or recessed from the front wall 103 of the connector housing 102.

Specifically, the recesses 115, 120 of the present embodiment include rectangular shaped areas 131, 132 to receive the LEDs of the subassemblies 200, 201, and are further shaped to accommodate the carrier elements 205 of the light source sub-assemblies (described with respect to FIGS. 2*a*–2*b* below) and hold the latter firmly in positioniwithin the housing 102. recesses 115, 120, retained by adhesives, tabs, detents, and/or any other similar mechanism as desired. In the illustrated embodiment, the carriers 205 are retained simply by friction between the carrier surface (and LED side surfaces) and the housing recess interior walls, thereby simplifying the manufacturing process.

Formed generally within each modular plug recess 105 in the housing element 102 of the connector of FIG. 1*a* are a plurality of grooves 122 which are disposed generally parallel and oriented substantially horizontally within the housing 102. The grooves 122 are spaced and adapted to guide and receive the aforementioned conductors 110 used to mate with the conductors of the respective modular plug.

Figure 1D:
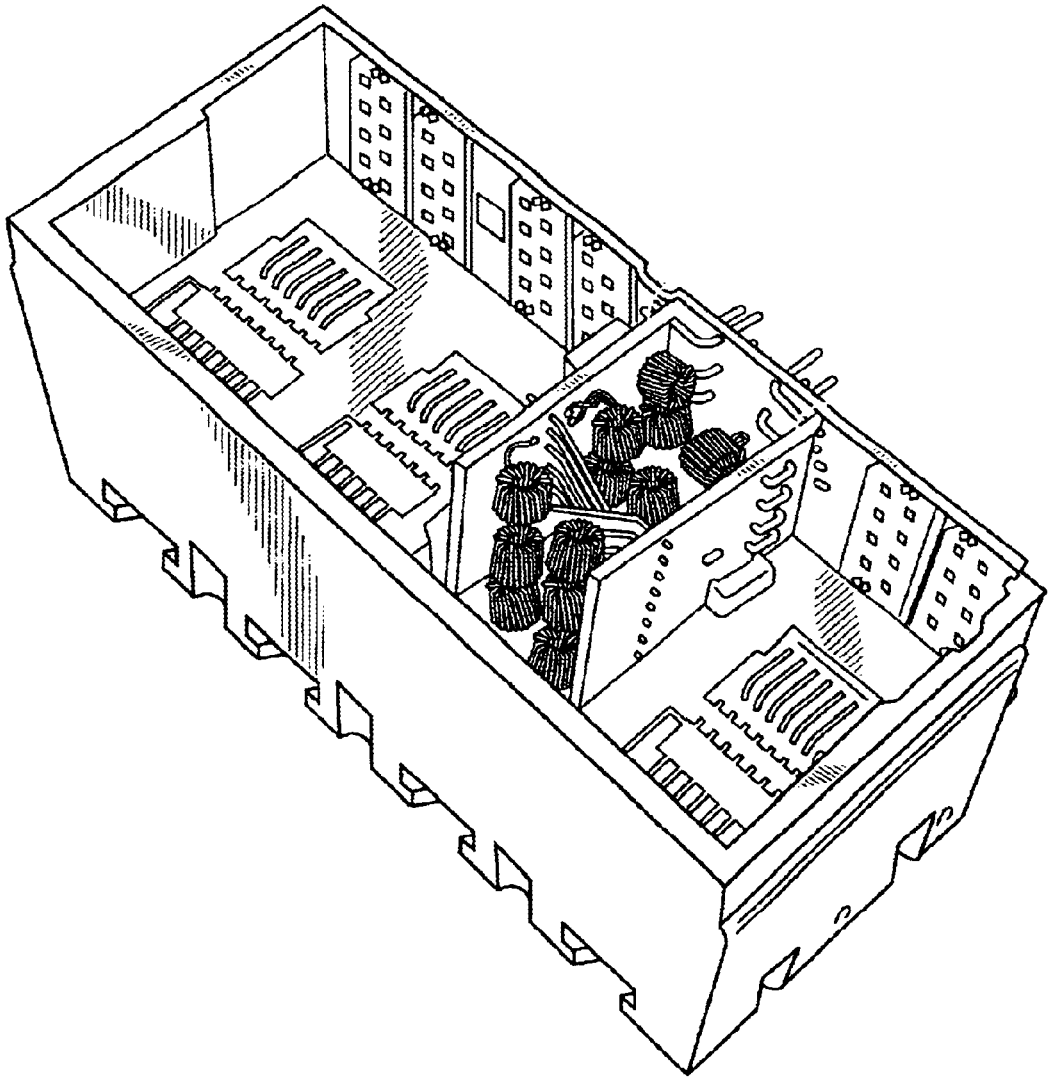
FIG. 1*d* is a rear perspective view of a second exemplary connector internal configuration which may be used in conjunction with the present invention.

Also optionally included in the connector assembly 100 is one or more substrates (not shown) for mounting electronic components within the connector. The substrates may comp se, for example, the substantially horizontal substrate and insert assembly Fi 1*c* as described in detail in co-pending U.S. patent application Ser. No. 10/139,907 entitled "Connector With Insert Assembly and Method of Manufacturing" assigned to the Assignees hereof and filed contemporaneously herewith, incorporated herein by reference in its entirety. Alternatively, the interior of the connector assembly 100 may be configured to receive one or more substantially vertical substrates (FIG. 1*d*) such as is described in co-pending U.S. patent application Ser. No. 10/099,645 entitled "Advanced Microelectronic Connector Assembly and Method of Manufacturing" filed Mar. 14, 2002, which claims priority to U.S. provisional application Serial No. 60/276,3 76 filed Mar. 16 2001, both owned by the co-Assignee hereof and incorporated by reference herein in their entirety. Numerous other interior configurations may be uti ized with the connector assembly of the present invention, thereby under coring one of its significant advantages (i.e., compatibility with most any connector internal configuration).

Figure 2B:
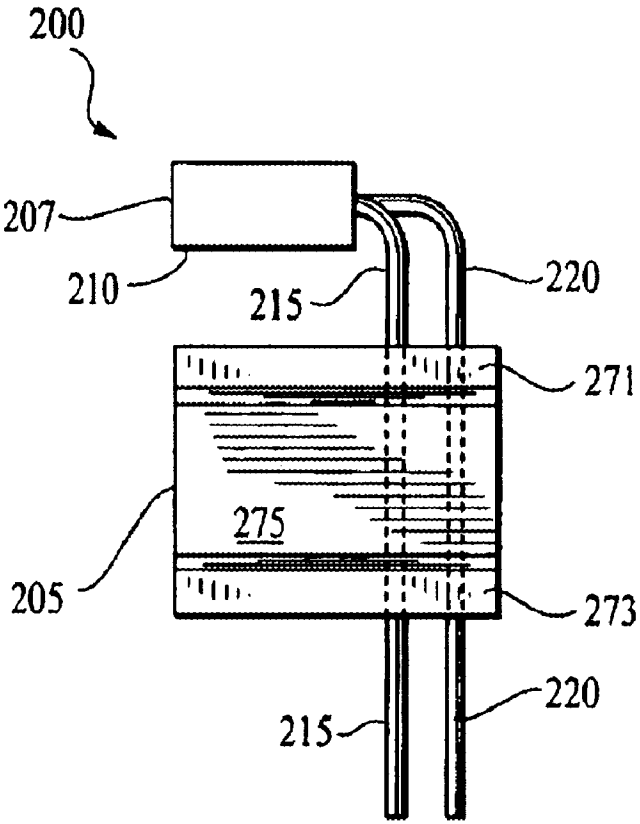
FIG. 2*b* is a side plan view of the light source sub-assembly of FIG. 2*a*.
Figure 2A:
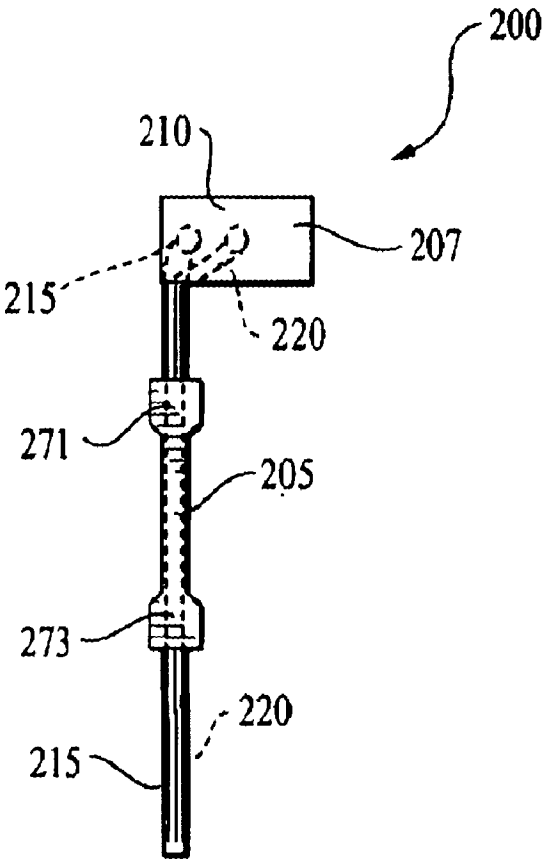
FIG. 2*a* is a front plan view of a light source sub-assembly for insertion into the left-hand side of the connector assembly housing.

Referring now to FIGS. 2*a*–2*b*, a first exemplary embodiment of a light source sub-assembly 200 as used with the connector assembly 100 of FIG. 1 is illustrated. It will be noted that while the sub-assembly 200 of FIGS. 2*a*–2*b* is described in terms of the single-port embodiment of FIGS. 1*a*–1*b,* it may be used with equal success in multi-port embodiments such as those described herein with respect to FIGS. 4–5*c*, and FIG. 6.

FIG. 2*a* is a front-plan view of the light source sub-assembly 200 adapted to be inserted into the left-side light source sub-assembly recesses 115 of the connector housing 102 of FIGS. 1*a*–1*b.* The complementary right-side sub-assembly 201 (described below with respect to FIG. 3) is received in the housing 102; in the present embodiment, the right-side sub-assembly 201 is a mirror image of the left-side sub-assembly.

The light source sub-assembly 200 includes a light source carrier element 205 and a light source 210 (e.g., a light-emitting diode, or LED). The light source 210 (and its right-side counterpart 310 described below) used in each connector 100 radiate visible light of the desired wavelength (s), such as green light from one LED and yellow light from the other, although multi-chromatic devices (such as a "white light" LED), or even other types of light sources such as for example incandescent lights, liquid crystal (LCD), or thin film transistor (TFT) devices, may be substituted if desired, all such devices being well known in the electronic arts. For simplicity, however, the following discussion assumes that the light sources comprise LEDs of the type commercially available at very low cost.

The LED 210 of FIG. 2*a* further comprises a pair of electrically conductive electrodes 215, 220, and a front or viewing surface 207 which, after deformation of the electrodes, faces forward in the connector housing 102 such that the light source can be viewed from the front of the connector assembly. The LED 210 is generally used by the equipment operator as an indicator of the electrical status of the connector, as is well known in the art.

The LED electrodes are preferably adapted for insertion into the light source sub-assembly such that the light source is disposed into the desired orientation. As such, when the light source sub-assembly is inserted into the sub-assembly recess 115 of a corresponding connector housing 102, the light source will be suitably oriented within the connector assembly. For example, as shown in FIG. 2*b*, both the light source electrodes may be bent 90 degrees near the LED 210 so that the majority of the electrodes route vertically downward in a substantially juxtaposed array through the light source carrier 205 and the LED itself achieves the desired orientation with respect to the front face of the connector assembly.

Note from the front-plan view of FIG. 2*a* that the viewing surface 207 of the LED 210 faces out of the plane of the Figure and is right-of-center (i.e., closer to the modular jack port 105 of FIG. 1*a* when the sub-assembly 200 is installed in the housing 102) with respect to a vertical axis 209 running through the light source carrier element 205. The front surface 207 is made to face the front of the light source sub-assembly 200 by deforming the electrodes 215, 220 as shown in the side plan view of FIG. 2*b*. In order to make the viewing surface 207 face forward and also be off center as shown in FIG. 2*a*, one of the electrodes can be bent by another 90 degrees, but in a different plane of rotation.

As shown in FIGS. 2*a*–2*b*, the carrier element 205 is shaped with a generally "dogbone" frontal cross-section having top and bottom electrode elements 271, 273 and a center web region 275, which is adapted for receipt within the correspondingly shaped housing recess 115 as previously described. As used herein, the term "dogbone" refers to any cross-sectional shape having two end portions and a central, more narrow portion connecting the two. Such shapes may be two-axis symmetric (i.e., symmetric with respect to both axes), one-axis symmetric (symmetric with respect to one axis) or asymmetric. As shown in FIG. 2*b*, the carrier 205 is elongated in depth as compared to its width, thereby providing stability to the LED electrodes and the sub-assembly in general, and allowing for the retention of multiple LEDs or light sources if desired (see discussion of multi-port embodiment below). The "dogbone" shape further advantageously economizes on lateral space or profile in the connector, since it is shaped to make some use of existing, otherwise unutilized wall thickness.

It will be recognized, however, that other shapes may be used in conjunction with the carrier element 205. For example, instead of the aforementioned "dogbone", an effectively flat plane (not shown) could be substituted, the electrodes of the LED(s) being molded directly within the thickness of the plane. As another alternative, the carriers may be formed as two or more separate components, such as using upper and lower electrode carriers 271, 273 without the center web region 275. As yet another alternative, the carrier 205 may be a "C" shaped molding or stamping. The carriers 205 may also be made shorter or longer in depth, such as by reducing the depth 277 of the carrier of FIG. 2*b* so as to accommodate only one LED and pair of electrodes. Numerous other variations of carrier variation may be used consistent with the invention based on the desired attributes for a particular application, such variations being within the skill level of the ordinary artisan.

In yet another embodiment, the connector housing 102, recesses 115, 120, and light source sub-assemblies 220, 221 may be adapted to receive the electrodes 215, 220 directly within the housing 102 without need for separate carrier elements 205 of FIGS. 1 and 2. Specifically, in this alternate embodiment, the recesses 115, 120 are made narrower than as shown in FIG. 1*a* and roughly the width of the electrodes so as to receive the electrodes frictionally therein, with the distal ends of the electrodes projecting downward toward the mounting substrate (external device) through the bottom wall of the connector housing 102.

Referring now to FIG. 3, a light source 300 as used in a right-side light source sub-assembly 201 is illustrated. The light source 300 is similar to the left-side light source 210, but is adapted to fit into the right-side light source sub-assembly 201. In this discussion, the light source is again taken to be a standard LED by way of example. The light source 300 includes light emitting element 310 (e.g., LED 310) and a pair of electrodes 315, 320. The electrodes are bent to cause the front or viewing surface 307 to communicate with the front face of the connector assembly 100. The electrodes 315, 320 are also deformed so as to cause the center of the viewing surface 307 to be left-of-center with respect to the axis of the electrodes 315, 320 that is oriented in a substantially normal direction with respect to the substrate (not shown) on which the connector is mounted. This substantially normal orientation minimizes the length of electrode run, and permits the electrode distal ends 323 to be received directly within corresponding apertures formed in the substrate without lateral stress on the latter.

Figure 3C:
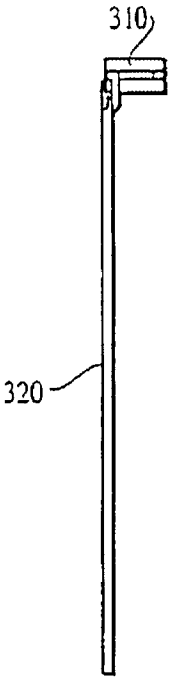
FIGS. 3*a*–3*d* respectively show front plan, right-side plan, rear plan and bottom plan views of the light source customized for mating with the right-side light source sub-assembly of the connector of FIG. 1*a*.
Figure 3B:
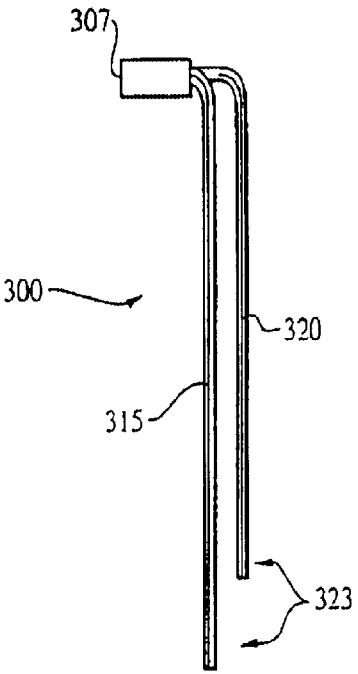
Figure 3A:
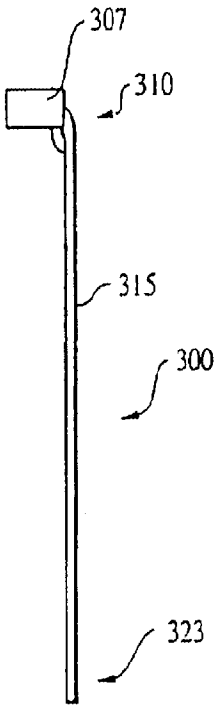

The side-plan view of FIG. 3*b* further illustrates how the electrodes 315 and 320 are bent 90 degrees in order to cause the viewing surface 307 to face in the desired orientation within the connector housing recess 120. The rear-plan view of FIG. 3*c* shows the LED 300 as it would be seen if viewed from behind.

Figure 3D:
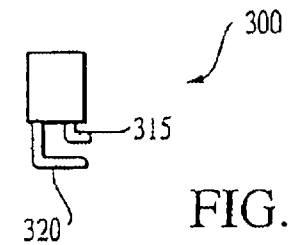

FIG. 3*d* is a bottom-plan view of the light source 300. Note that the electrode 315 is bent through another 90 degrees in addition to the bend shown in FIG. 3*b*. That is, the electrode 315 is twice bent in two different planes of rotation. The first bend of FIG. 3*b* causes the viewing surface 307 to face horizontally instead of vertically, and the second bend of FIG. 3*d* causes the viewing surface 307 to have its center moved to the left of the vertical axis formed by the electrodes as per FIG. 3*a*.

It should be noted that the electrode configurations described above are exemplary and are in no way intended to be limiting. Specifically, other electrode configurations with alternate bend radii, locations, and orientations may be substituted in order to achieve a desired configuration for a light source sub-assembly. Furthermore, the recesses 115, 120 formed within the connector housing 102 may be adapted to accommodate any desired relationship between light source and carrier.

Also, it will be appreciated that the light source elements 210, 310 need not be rectangular in cross-section, but could take on other shapes such as square, round, oval, or various parallelepiped shapes, for example. Their viewing surfaces 207, 307 need not be planar either, but rather may be concave, convex, or literally any other shape desired. Varying offsets between the front or viewing surfaces 207, 307 of the light sources and the front face of the connector housing 102 may also be utilized if desired, and are contemplated by the present disclosure.

Multi-Port Embodiment

Figure 4:
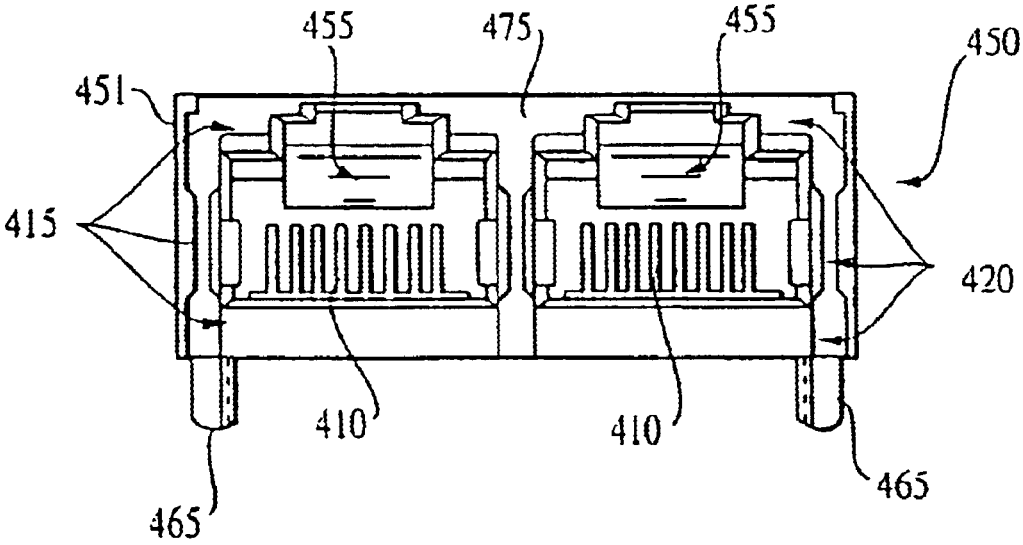
FIG. 4 is a front plan view of the exemplary embodiment of a multi-port (two port) connector housing having three light source sub-assemblies received therein.
Figure 5B:
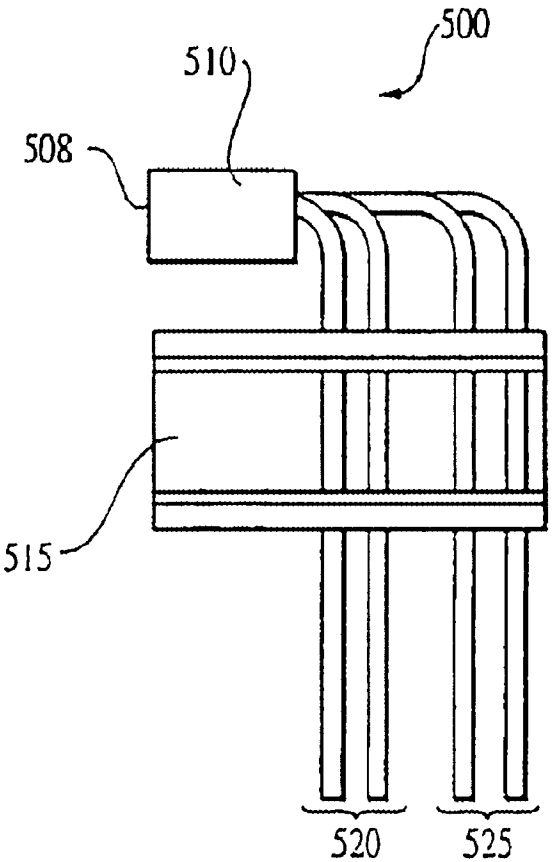
FIGS. 5*a*–5*b* are front and side plan views, respectively, of an interstitial light source sub-assembly having a plurality of light sources, as used with the connector housing of FIG. 4.
Figure 5A:
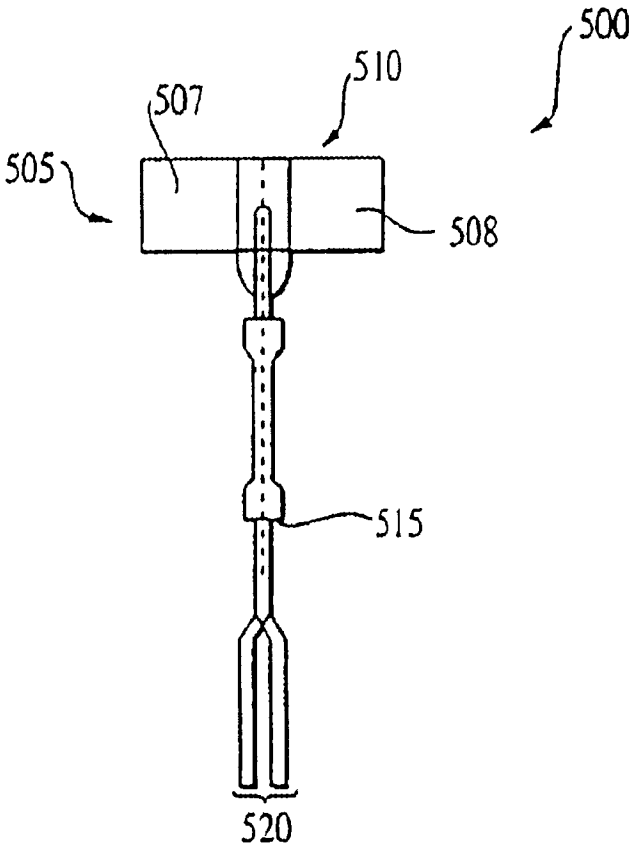
Figure 5C:
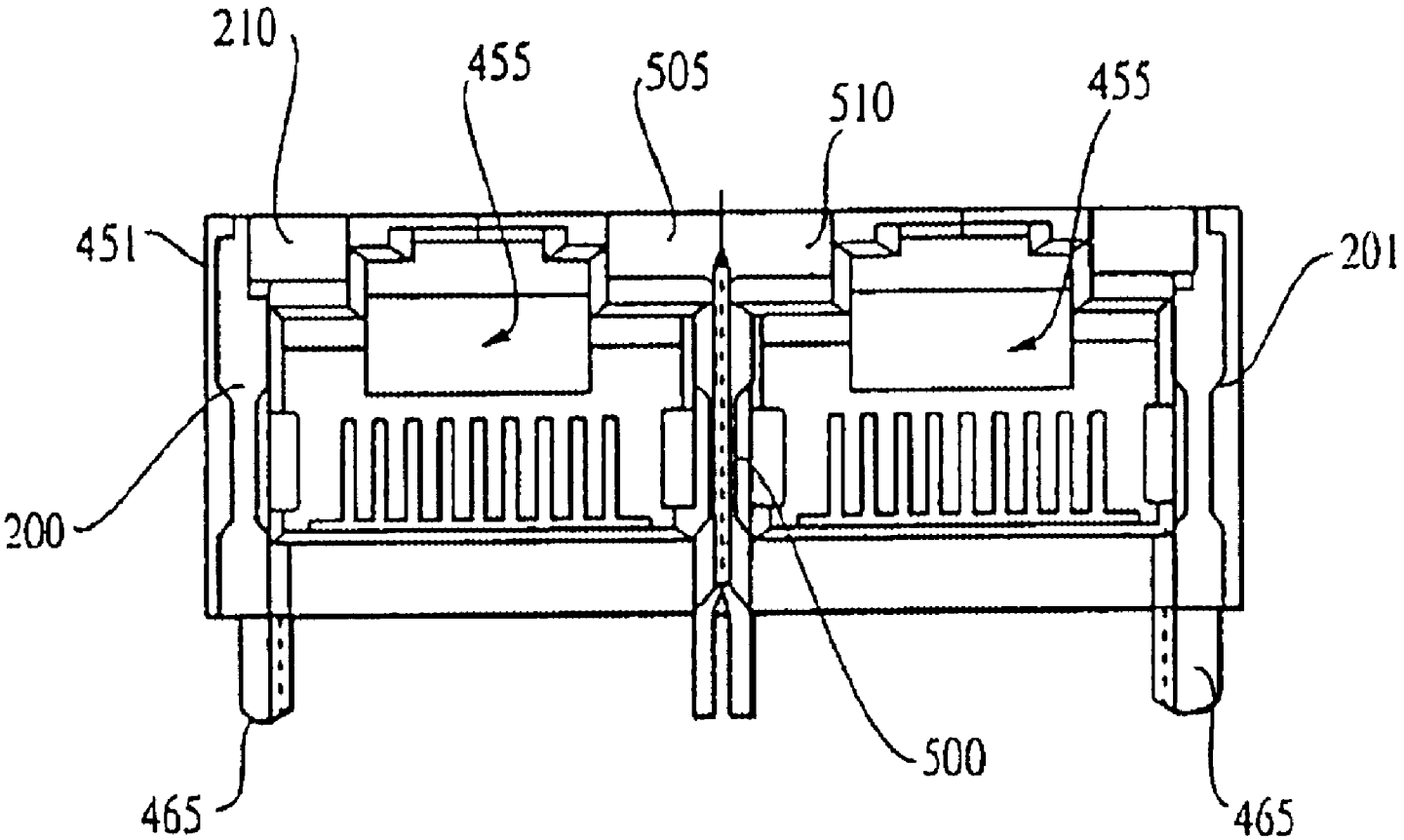
FIG. 5*c* is a front plan view of the connector housing of FIG. 4 with the light source sub-assemblies received therein.

Referring now to FIGS. 4–5*c*, a second embodiment of the connector assembly of the present invention is described. As shown in FIG. 4, the assembly 450 generally comprises a connector housing element 451 having a plurality (i.e., 2) of modular plug-receiving connector recesses 455 formed therein. The front wall of the connector housing element 451 is preferably disposed generally perpendicular or orthogonal to the PCB surface (or other device) to which the connector assembly 450 is mounted, with the latch mechanism located away from the PCB, such that modular plugs may be inserted into the plug recesses 455 formed in the connector housing 451 without physical interference with the PCB; however, other configurations (e.g., "latch down") may be utilized consistent with the invention. The plug recesses 455 are adapted to each receive one modular plug (not shown) having a plurality of electrical conductors disposed therein in a predetermined array, the array being so adapted to mate with a set of respective conductors 410 present in the recesses 455 thereby each forming an electrical connection between the plug conductors and connector conductors 410. Each set of conductors 410 are coupled to an electrical pathway that leads to a respective PCB mating contact 425 for electrically coupling the connectors 410 to the PCB. A pair of connector posts 465 is also supplied for PCB connection. The connector-housing element 451 in the illustrative embodiment is electrically non-conductive and may be formed similarly to the connector housing 102 as discussed in connection with FIG. 1*a*.

The connector housing element 451 also includes one or more modular recesses, each for receiving a light source sub-assembly. In the exemplary embodiment 450, the housing element 451 includes a left-side light source sub-assembly recess 415, a middle or interstitial light source sub-assembly recess 475, and a right-side light source sub-assembly recess 420. In the exemplary embodiment of the connector 450, the right-side and left-side light source sub-assembly recesses are mirror-image symmetrical with respect to one another. The middle light source sub-assembly recess 475 includes space to receive a light source sub-assembly having two light sources as opposed to the left- and right-side recesses 415, 420 that each provide space to receive only a single light source.

Referring now to FIGS. 5*a*–5*c*, the interstitial light source sub-assembly 500 for insertion into the middle light source sub-assembly recess 475 of FIG. 4 is described. Note that FIG. 5*a* is a front-plan view of the light source sub-assembly 500 while FIG. 5*b* is a side-plan view of the same sub-assembly. FIG. 5*c* illustrates the sub-assembly 500 (as well as the left- and right-side subassemblies) inserted within the connector housing 451.

The interstitial light source sub-assembly 500 includes a first light source 505 having a first pair of electrodes 520. The light source sub-assembly 500 also includes a second light source 510 having a second pair of electrodes 525. The light source sub-assembly 500 also includes a light source carrier module 515. The light source carrier element 515 is similar in construction to the light source carrier element 205 previously described, but need not be identical, and can have any number of different shapes similar or different to the carrier element 205.

As illustrated in FIGS. 5*a* and 5*b*, the electrode pairs 520, 525 are routed downward through the light source carrier 515. As best shown in FIG. 5*a*, the light sources are oriented so that the front surfaces 507 and 508 of the light source elements 505 and 510 face in a direction normal to the plane of the Figure, toward the front of the connector. Using a complementary pair of bends such as that shown in FIG. 3*d*, the centers of the front surfaces 507 and 508 are respectively made to be left-of center and right-of-center as illustrated in FIG. 5*a*.

Although not shown, the light source sub-assemblies 200, 201, 500 can be constructed with additional electromagnetic shielding to further decouple light source switching transient noise from the connector's signal paths. For example, the light source sub-assembly can be constructed to include an insulated conduit or wrapping (e.g., shielding tape) to electromagnetically shield the light sources and/or the light source electrodes in the light source sub-assembly.

Alternatively, a thin layer of shielding material can be deposited on the inner surfaces of the light source recesses of the housing, as described below. Many other approaches to shielding may also be implemented consistent with the invention.

Certain advantages associated with the design of the connector assembly 500 become readily apparent to those skilled in the art. The use of the middle or interstitial light source sub-assembly recess 475 advantageously reduces overall production costs by simplifying the manufacturing process for the connector. This benefit is enhanced or multiplied when manufacturing connector assemblies having a plurality of interstitial light source sub-assemblies (such as in a "1×8" connector having one row of eight ports, wherein seven interstitial sub-assemblies are utilized; see FIG. 6 below). Additionally, by pre-fabricating the light source sub-assemblies 200, 201, 500, the process of inserting the light sources into the connector assembly 500 can be readily automated. In contrast, prior art methods that involve threading the electrodes of LEDs (or other light sources) through the connector assembly housing, such as that of Pocrass described above, are more cumbersome and can increase production costs.

Another key advantage to the light source configuration of present invention is that the electrodes of the light sources route vertically downward to the PCB or other device to which they are mounted (and away from the connector internal conductors 110), and thereby avoid much of the electromagnetic cross-coupling of noise associated with prior art solutions. The light source sub-assemblies can be constructed with additional noise shielding if desired to further limit the cross coupling of light source generated noise into the signal paths of the signal conductors 110. The downward routing of the light source electrodes also enhances the scope of connector internal configurations with which the light-source subassemblies may be used, since the connector internals are left essentially unaffected by the presence (or lack thereof) of the light source sub-assemblies.

Figure 6:
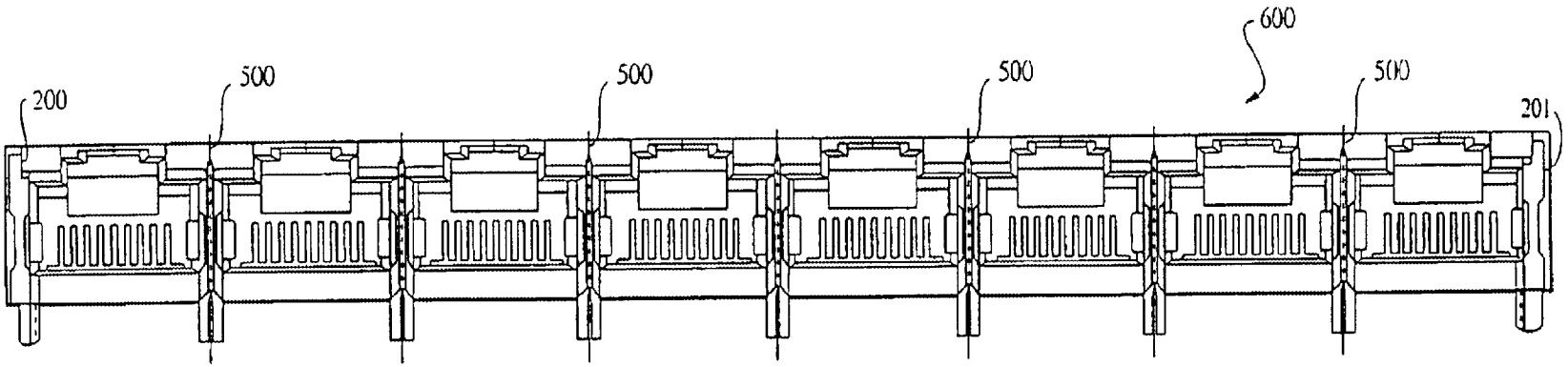
FIG. 6 is a front plan view of another exemplary embodiment of a multi-port connector assembly (eight ports) having nine light source sub-assemblies received therein.

FIG. 6 illustrates a connector assembly 600 that involves a one-by-eight (1×8) array of ports as opposed to the one-by-two array of ports provided by the connector assembly 00. The construction and structure of the connector 600 is similar to the construction and structure of the connector 450 previously described, and accordingly will not be repeated here.

As previously discussed, the light source sub-assemblies 200, 201, 500 may further be configured to include noise shielding for the individual light sources if desired. Likewise, connector assemblies 100, 450, 600 may be constructed to provide the shielding. If it is desired to shield the signal path conductors 110 from noise radiated by the LEDs, such shielding may be included within the connector assemblies and/or the light source sub-assemblies 200, 201, 500 in any number of different ways. In one embodiment, the LED shielding is accomplished by forming a thin metallic (e.g., copper, nickel, or copper-zinc alloy) layer on the interior walls of the light source sub-assembly recesses 115, 120, 475 (or even over the non-conductive portions of LED itself) prior to insertion of each light source sub-assembly. In another type of embodiment, the light source sub-assemblies are fabricated with an internal noise/EMI shielding layer (not shown) which may include, for example, inner-insulated conduits for the electrodes of the light sources. External connector shielding (such as a unitary shield applied over a portion of the outer portion of the connector housing) may also be employed as is common in the industry.

Figure 7:
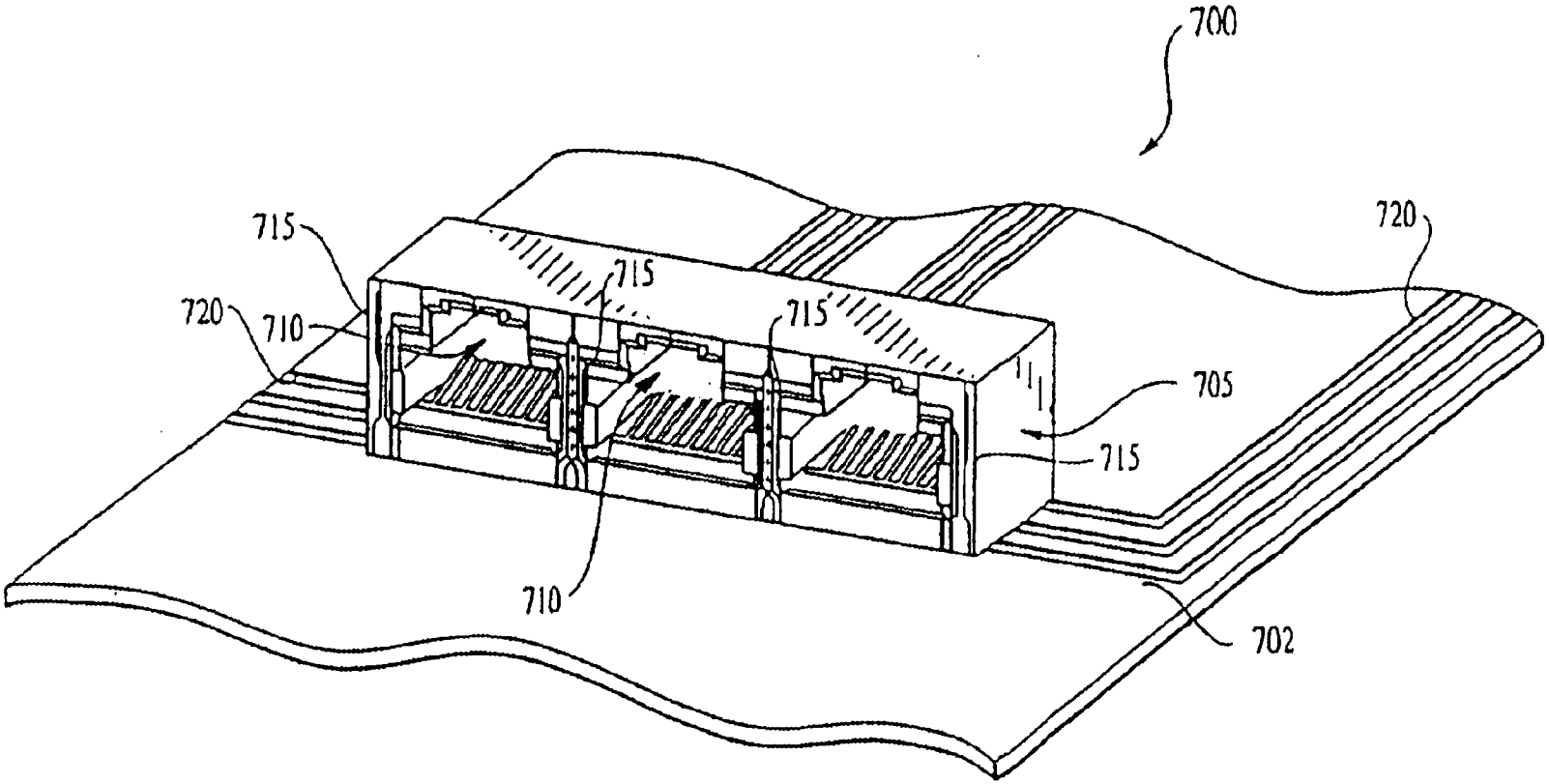
FIG. 7 is a perspective view illustrating the multi-port connector assembly of FIG. 6 mounted on a printed circuit board (PCB).
Figure 7A:
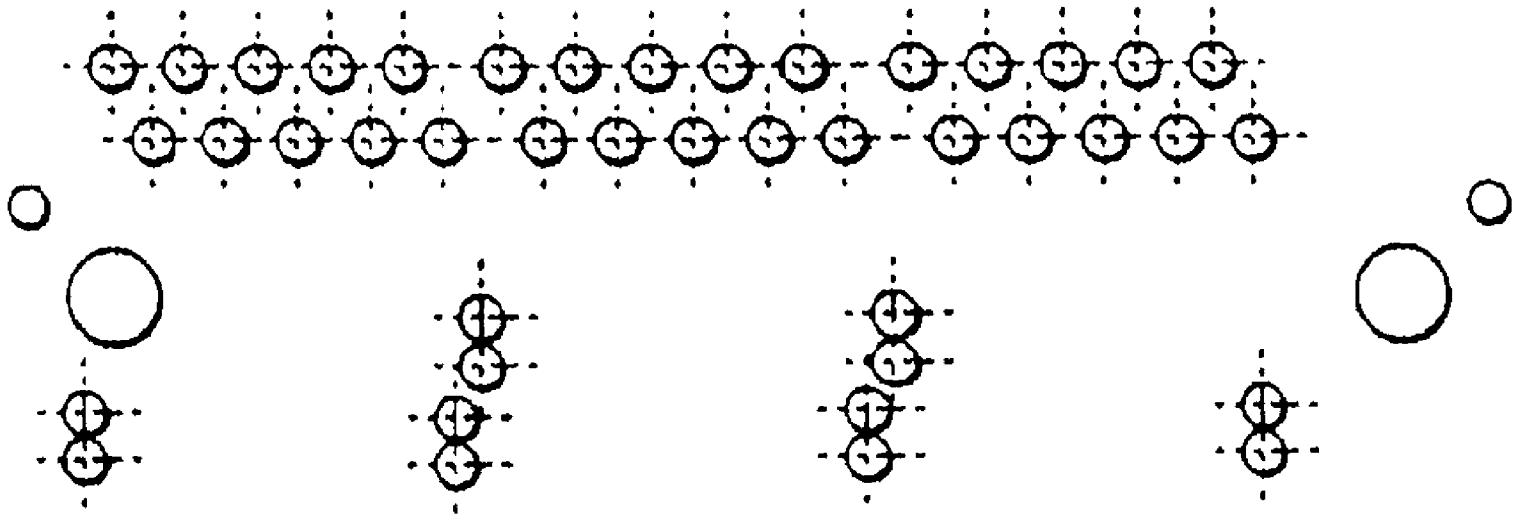
FIG. 7*a* is a top plan view of the aperture grid or array formed within the PCB of FIG. 7 for mating with the conductor and electrode terminals of the connector assembly.

FIG. 7 illustrates an electronic assembly 700 that includes a connector assembly 705 similar in design and structure to the connector assemblies 450 and 600 but in this example, with a set of three ports 710 and four light source sub-assemblies 715. The connector assembly 705 is mounted to an external substrate 702, in this case a PCB 702. As shown in FIG. 7, the connector assembly 705 is mounted such that the PCB mating contacts, to include both the signal path contacts and the distal ends of the light source electrodes, penetrate through respective apertures (connection points, not shown) formed in the PCB 702. The mating contacts are soldered to a set of conductive traces 720 immediately surrounding the apertures, thereby forming a permanent electrical contact there between, and providing some degree of physical support. The connector housing may also be fitted with positioning posts (such as the posts 130 of FIG. 1*a*) of the type well known in the modular connector arts, thereby registering the connector assembly 705 with respect to corresponding apertures formed in the PCB. The conductors (and electrodes) are configured into a predetermined pin-out arrangement for electrically connecting the connector 705 to the substrate 702, such as that shown in FIG. 7*a*. Note that while a conductor/aperture approach is shown in the embodiment FIG. 7, other mounting techniques and configurations may be used. For example, the mating array conductors may be formed in such a configuration so as to permit surface mounting of the connector assembly 705 to the PCB 702, thereby obviating the need for the apertures. As another alternative, the connector assembly 705 may be mounted to an intermediary substrate (not shown), the intermediary substrate being mounted to the PCB 702 via a surface mount terminal array such as a ball grid array (BGA), pin grid array (PGA), or other non-surface mount technique. The footprint of the terminal array may be reduced with respect to that of the connector assembly 705, and the vertical spacing between the PCB 702 and the intermediary substrate adjusted such that other components may be mounted to the PCB 702 outside of the footprint of the intermediary substrate terminal array but within the footprint of the connector assembly 705.

Multi-Row, Multi-Port Embodiment

Figure 8A:
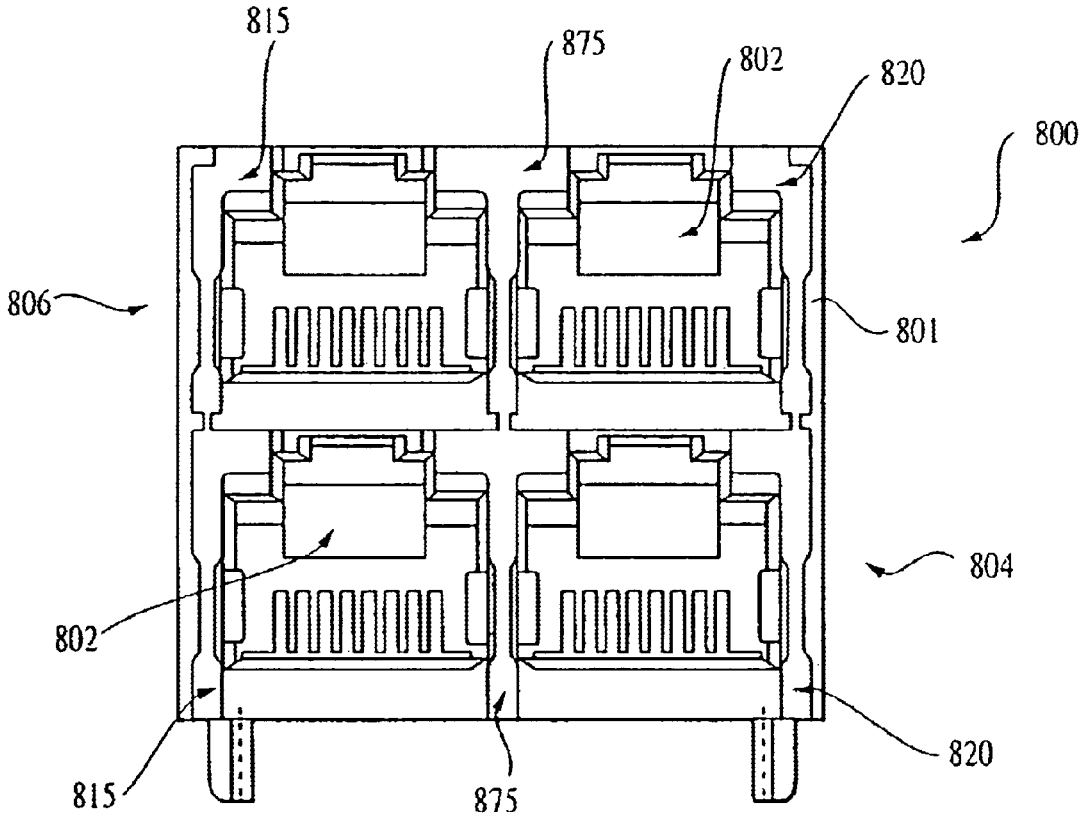
FIG. 8*a* is a front plan view of another embodiment of the connector assembly of the present invention, comprising a housing having two rows of multiple ports
Figure 8C:
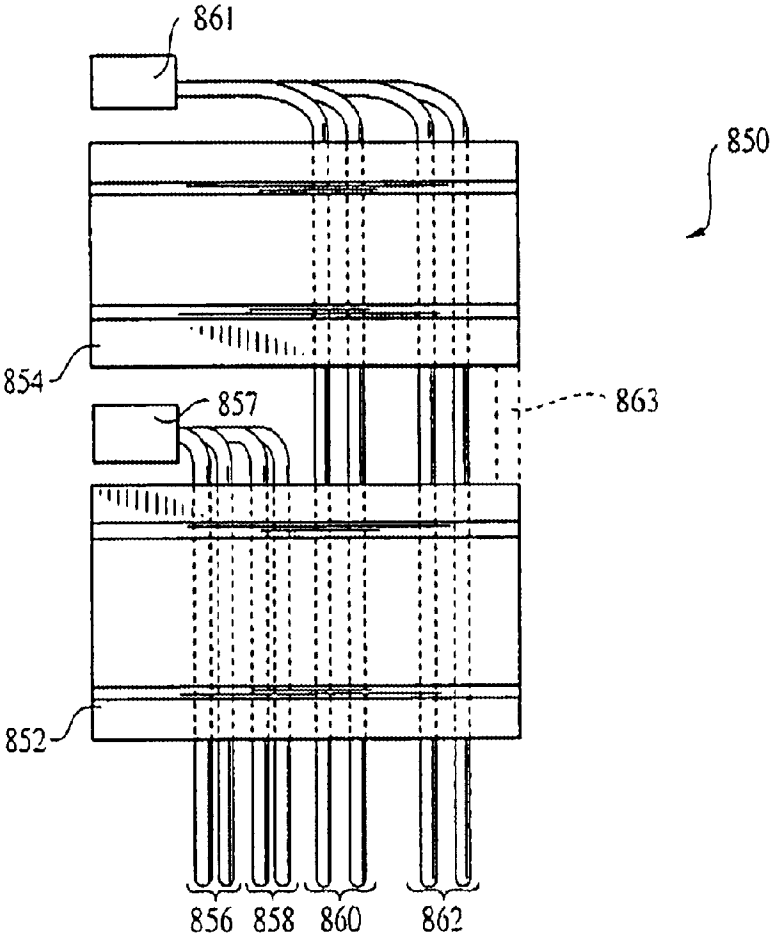
FIGS. 8*b* and 8*c* are front and side plan views, respectively, of the interstitial light source sub-assembly adapted for use with the housing of FIG. 8*a*.
Figure 8B:
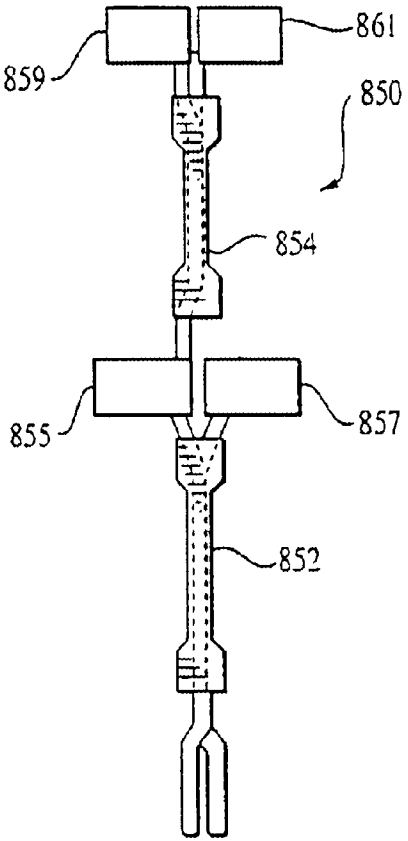

Referring now to FIGS. 8*a*–8*c*, yet another embodiment of the connector assembly of the present invention is described. As shown in FIG. 8*a*, the connector assembly 800 generally comprises a housing 801 having a plurality of modular jack ports (four) 802 arranged in row-and-column configuration, such that two of the ports are disposed in a first row 804, and two ports in a second row 806. It will be appreciated that the number of ports, rows, and columns may be varied as desired, and hence the illustrated configuration is merely exemplary. A plurality of light source recesses 815, 820, 875 are formed within the housing to receive corresponding light source sub-assemblies 830, 840, 850 as described with respect to FIGS. 8*b* and 8*c* below. The recesses two outer or side recesses 815, 820 are disposed on either end of the housing 801 and are generally similar to those described previously herein, with the exception that each are elongated to accommodate multiple, deeper (i.e., horizontally longer) carrier elements, as shown in the exemplary interstitial light source sub-assembly 850 of FIGS. 8*b* and 8*c*. Specifically, the interstitial light source sub-assembly 850 includes first and second carrier elements 852, 854 disposed in "over-under" arrangement, with the sets of electrodes 856, 858, 860, 862 of the four light sources 855, 857, 859, 861 (here, LEDs) being routed through one or both of the carriers 852, 854 as best shown in FIG. 8*c*. Accordingly, the light source arrangement of FIGS. 8*b*–8*c* is completely analogous to that previously described herein with respect to the single port and multi-port, single row embodiments, with the exception that a second carrier and set of LEDs is disposed vertically atop the first. Note also that one or more bridge elements 863 can be formed between the two carriers 852, 854 of the interstitial subassembly 850 if desired so as to add mechanical rigidity to the sub-assembly other than that imparted by the electrodes alone. Such bridge elements may comprise, for example, molded web(s) between the two carrier elements 852, 854 as shown in FIG. 8*c*, or any other support arrangement of the type well known in the mechanical arts.

It will be recognized that the embodiment of FIGS. 8*a*–8*c* is merely exemplary in design, and the foregoing variations, modifications, or alternatives previously described herein with respect to the other embodiments (such as, for example, the use of carriers of different shape, or different types of light sources, etc.) may be applied equally hereto.

Method of Manufacture

Figure 9:
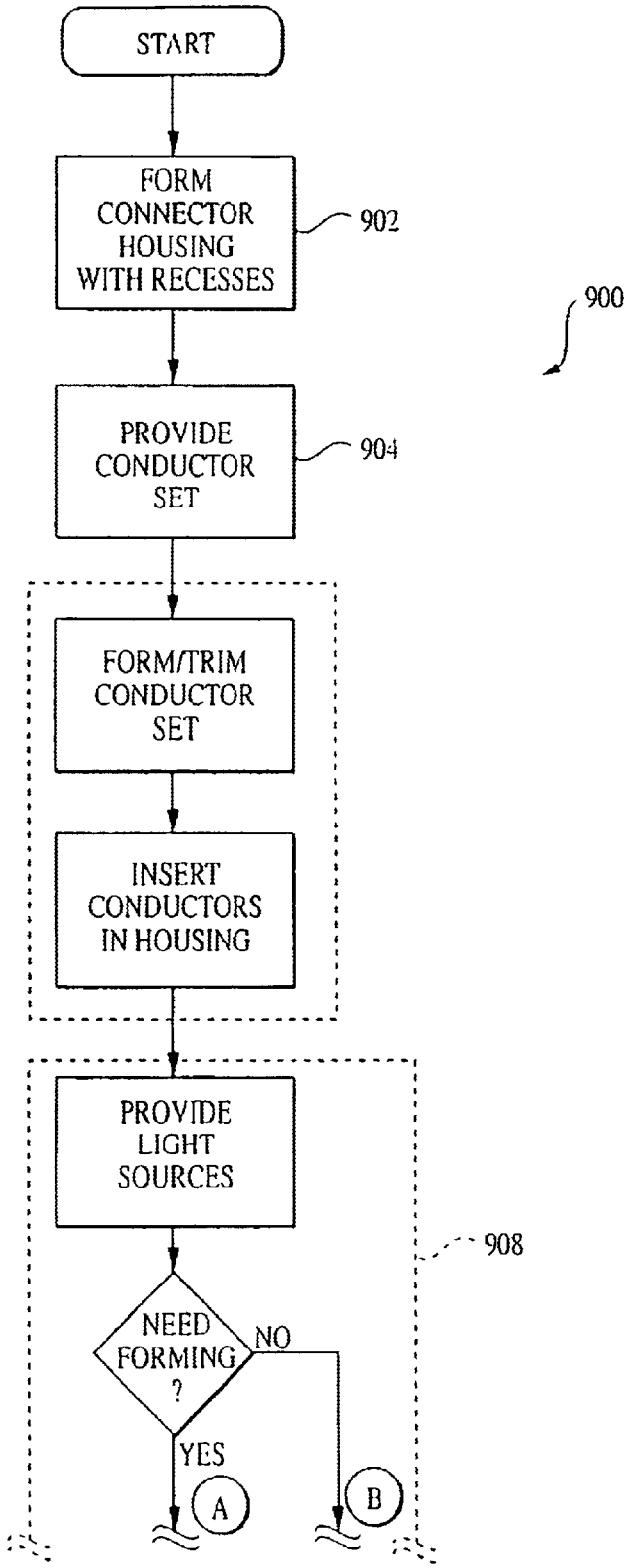
FIG. 9 is a logical flow diagram illustrating a first exemplary embodiment of the method of manufacturing the connector assembly of the present invention.
Figure 9:
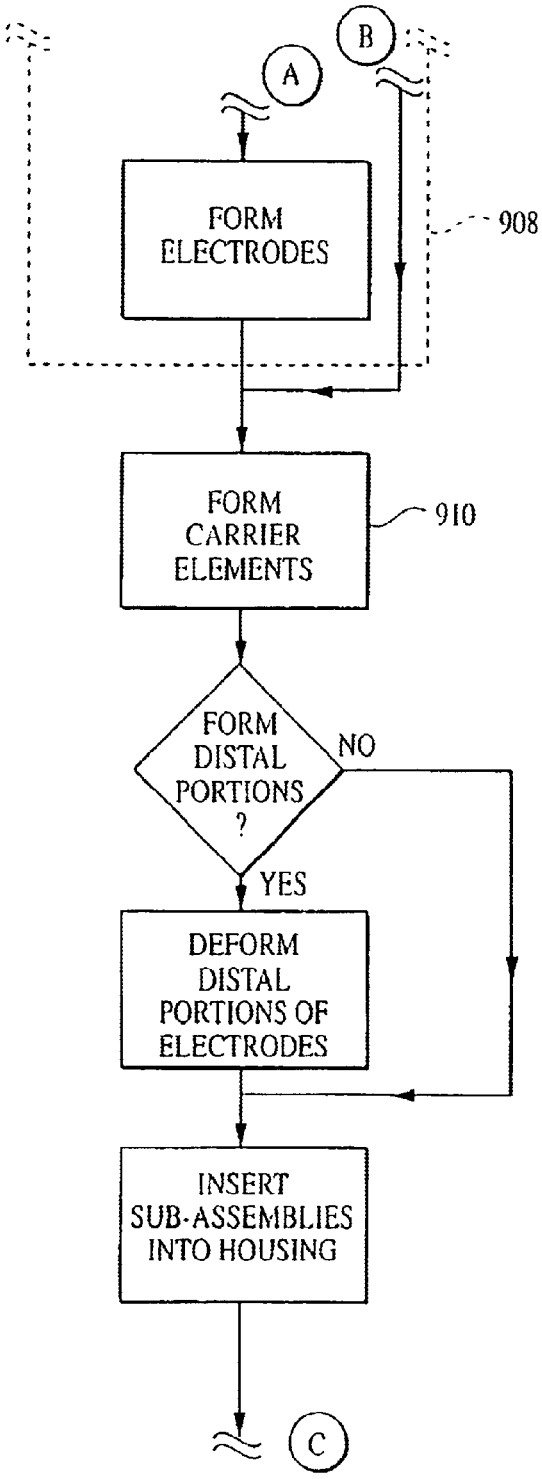
Figure 9:
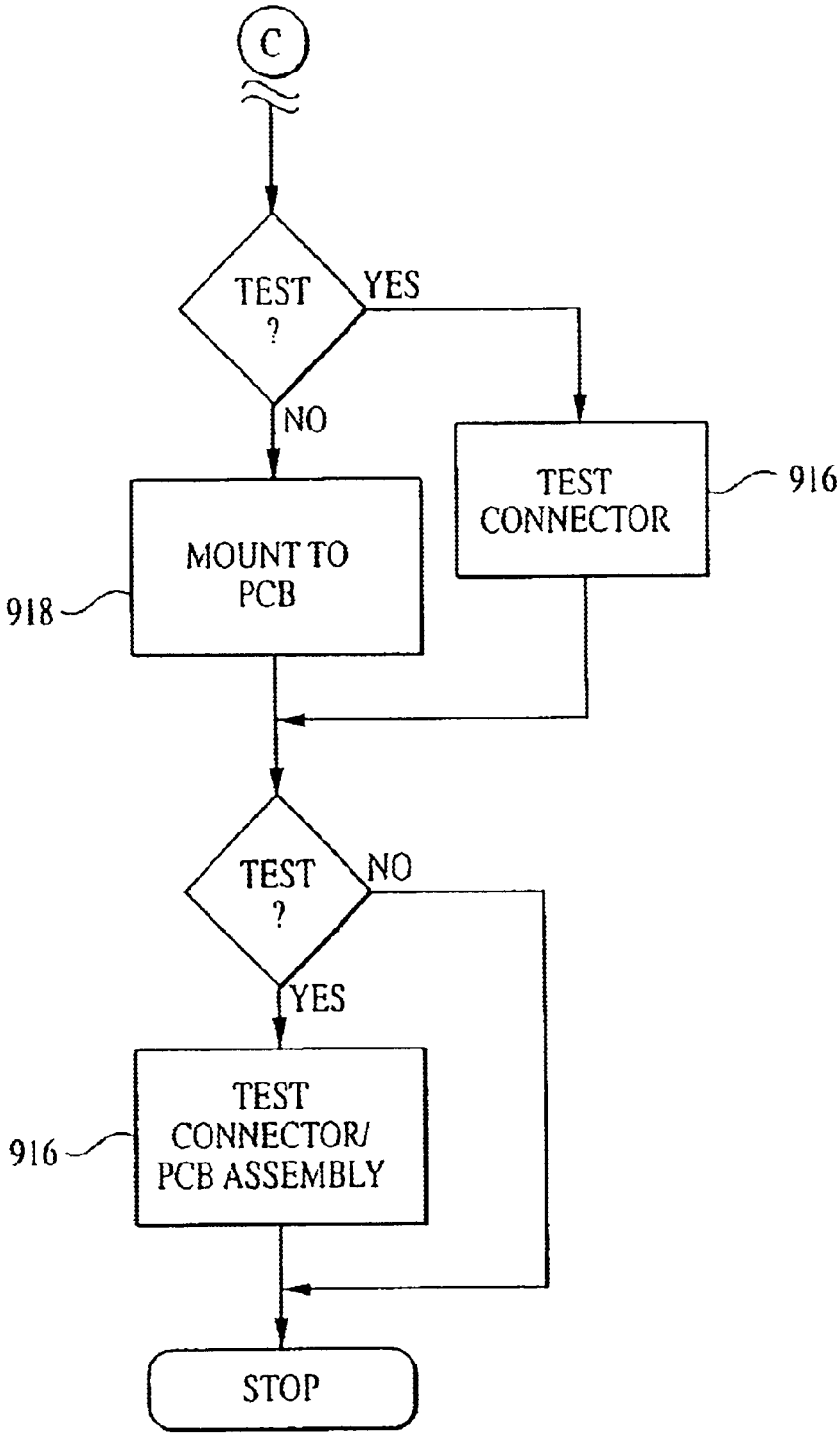

Referring now to FIG. 9, a method 900 of manufacturing the aforementioned connector assembly of the present invention is described in detail. It is noted that while the following description of the method 900 of FIG. 9 is cast in terms of a multi-port connector assembly (such as that of FIGS. 4–5*c*), the broader method of the invention is equally applicable to other configurations including the single-port embodiment of FIG. 1*a,* and even multi-row configurations such as shown in FIGS. 8*a*–8*c*. Also, various combinations of the steps of the method 900 can be aggregated, and/or their order permuted, to define sub-methods of manufacturing as is discussed below.

It will further be noted that the method 900 can be carried out in a distributed or multi-tasked fashion. That is, a single manufacturing entity need not carry out each step or groups of steps. For example, different entities may be subcontracted to manufacture different sub-assemblies and still another subcontractor or the primary manufacturing entity may perform the final assembly using all of the sub-assemblies and components formed in the various steps.

In the embodiment of FIG. 9, the method 900 generally comprises first forming the connector-housing element 451 in step 902. The formed connector-housing element has left-side and right-side light source sub-assembly recesses 415, 420, and the interstitial recess 475. The connector-housing element is also formed to include at least one modular plug receiving recess 455 and a rear cavity disposed therein. The connector-housing element is formed using an injection molding process of the type well known in the art, although other processes may be used. The injection molding process is chosen for its ability to accurately replicate small details of the mold, low cost, and ease of processing. In some embodiments, noise shielding may be added to various regions of the connector-housing element as a sub-step of housing formation step 902.

Next, the conductor set 410 is provided in step 904. As previously described, the conductor set comprises metallic (e.g., copper or aluminum alloy) strips having a substantially square or rectangular cross-section and sized to fit within the slots of the connectors in the housing 451.

In step 906, the conductors are oriented and deformed for use within the connector recess (i.e., within the housing 451, and mating with the modular plug terminals), and are routed to the external device such as the PCB 702 of FIG. 7. The conductors are formed to the desired shape(s) using a forming die or machine of the type well known in the art. Specifically, for the embodiment of FIG. 4, the conductor set 410 is deformed to produce the desired juxtaposed, coplanar array which is used to mate the connector plug (e.g. male RJ connector type), and the terminal array adapted to mate with the PCB/external device 702. As previously described, the light source subassemblies of the present invention are effectively independent of the internal configuration of the connector; hence, literally any internal configuration of conductors 410 and other electronic and/or signal conditioning components may be utilized. For example, the conductors 410 may each comprise multiple segments with interposed signal conditioning components disposed on a substrate, such as described in the previously referenced co-pending U.S. patent application Ser. No. 10/139,907 filed contemporaneously herewith. Many other configurations may also be utilized; hence, it will be recognized that the foregoing discussion of formation and placement of the conductors 410 per step 906 is merely exemplary in nature.

In a step 908, one or more light sources are provided with the desired electrode configurations. This process may be carried out in several alternative ways. In one exemplary embodiment, a set of light sources such as standard commercial LEDs may be purchased and the electrodes deformed into the desired bend configurations such as those shown in FIGS. 5*a*–5*b* using any number of well deformation technologies such as machine bending and the like. Such LEDs are commonly manufactured at low cost and such that the electrodes are straight, thereby requiring subsequent bending. Alternatively, step 908 may involve a custom manufacturing run to construct a set of customized light sources having the desired electrode configurations. In yet another alternative, the deformation of the electrodes may occur after the carrier elements are molded or placed onto the electrodes as described in step 910 below. Any number of different approaches and/or combinations of the foregoing may be employed to provide the desired light source electrode configurations.

In a step 910, one or more light source carrier elements 205, 415 are formed. The light source carrier elements are formed to fit within their corresponding housing recesses 415, 420, 475 and to include at least one set of apertures for receiving one or more electrodes of a light source. In the present embodiment, this process comprises molding the carrier elements directly around the electrodes using an injection molding process of the type well known in the art, although other processes may be used. For example, the carrier elements (with apertures) may be formed independent of the electrodes, and the electrodes subsequently inserted therein before or after deformation of the latter.

In a step 912, the distal portions of the light source electrodes are optionally deformed (such as shown in FIG. 5*a* herein) after being received within the carrier element(s) so as to form the desired terminal array spacing and pattern. Such deformation is accomplished using similar methods to those described above with respect to step 908. Note that if the carrier elements are molded around the light source electrodes, this step (912) may be performed at any time with respect to carrier formation, since the distal portions of the electrodes need not pass through the carrier element apertures. Alternatively, however, when the carrier elements 205, 415 are pre-molded and the electrodes subsequently inserted therein, the distal ends should be deformed after such step of inserting.

The finished light source sub-assemblies 415, 420, are then inserted into the housing element 451 in step 914 within their corresponding recesses 415, 420, 475). Such insertion in one embodiment comprises manually inserting the rearward portion of each sub-assembly first into its housing recess, and then when aligned, gently forcing the carrier element (and light sources) into place within the housing to seat them in their desired location. Alternatively, such insertion operations may be automated using, for example, a variant of a "pick-and-place" machine of the type well known in the manufacturing arts. It will also be recognized that the insertion of the various light source sub-assemblies into their corresponding recesses may be accomplished in parallel, such that all sub-assemblies are inserted into the housing in a simultaneous manner.

Note also that to facilitate such insertion, the carrier elements (and even the rearward portions of the light source bodies) may be shaped or tapered so as to accommodate a certain degree of misalignment. For example, a "V" shaped taper on the back edge of the carrier elements (not shown) may be used to help guide each carrier and sub-assembly into proper position for further insertion, thereby further facilitating manual or automated assembly of the connector.

Lastly, in optional steps 916, 918, the connector assembly 450 is electrically tested (including test illumination of the light sources), and mounted onto an external device such as the PCB 702. The connector assembly may be tested after mounting on the external device as well. In the present embodiment, the act of mounting comprises placing the connector on the external device such that the various conductors 410 and electrode distal ends are received within the corresponding apertures of the PCB 702, and then reflow soldering the former to the latter to form an electrical pathway. Other techniques such as surface mounting and the like may be utilized in the alternative, as previously described herein.

It will be recognized that while certain aspects of the invention are described in terms of a specific sequence of steps of a method, these descriptions are only illustrative of the broader methods of the invention, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the invention disclosed and claimed herein.

While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. A connector assembly comprising:

at least one sub-assembly having:

at least one a light source having at least one electrode; and at least one carrier element, said carrier element being adapted to receive at least a portion of said at least one electrode; and a connector housing having:

a first recess adapt to receive at least a portion of a modular plug, said modular plug having a plurality of terminals disposed thereon;

at least one second recess adapted to receive at least a portion of said at least one sub-assembly via a front face of said housing;

a plurality of conductors, said plurality of conductors being at least partly disposed within said first recess, said conductors being configured to form electrical pathways between respective ones of said terminals of said modular plug and an external device when said modular plug is received within said first recess and said connector assembly is mated to said external device;

whereby when said at least one sub-assembly is inserted in said at least one second recess, said at least one electrode is positioned to be electrically mated with said external device.

2. The connector assembly of claim 1, wherein said at least one light source comprises a light-emitting diode having two electrodes.

3. The connector assembly of claim 2, wherein said at least one carrier element receives at least a portion of each of said two electrodes.

4. The connector assembly of claim 1, wherein said at least one second recess is disposed adjacent the sidewall of said connector housing proximate to said first recess.

5. The connector assembly of claim 1, wherein said at least one carrier element is substantially planar, and said at least one light source is disposed offset from the plane of said at least one carrier element.

6. The connector assembly of claim 1, further comprising at least one electronic component dispqsed within at least one of said electrical pathways, said electrical component adapted to condition electrical signals flowing through said at least one pathway.

7. The connec tor assembly of claim 1, wherein said external device comprises a printed circuit board (PCB), and said electrical mating comprises placing said at least one electrode in electrical communication with corresponding ones of conductive traces of said PCB.

8. A connector assembly comprising:

at least one sub-assembly halving at least one a light source and at least one carrier element, said carrier element being adapted to receive at least a portion of said at least one light source; and a connector housing having front face and at least one recess formed substantially within said front face, said at least one recess being adapted to receive at least a portion of said at least one sub-assembly via said front face;

whereby when said at least one sub-assembly is inserted in said recess, said at least one light source is positioned so as to be electrically coupled to an external device, and viewable from said front face of said housing.

9. The connector assembly of claim 8, wherein said at least one light source comprises an LED having a plurality of electrodes, and said electrical coupling comprises placing said electrodes in electrical communication with corresponding ones of conductive traces of said external device.

10. The connector assembly of claim 8, wherein said at least one carrier element comprises a substantially planar element, said planar element being received within said at least one recess in a vertical orientation.

11. The connector assembly of claim 10, wherein said at least one light source is disposed offset from the plane of said planar element.

12. The connector assembly of claim 8, wherein said at least one carrier element comprises top and bottom electrode portions and a central portion disposed therebetween.

13. A connector assembly comprising:

at least one sub-assembly having:

at least two light sources each having at least one electrode; and at least one carrier element, said carrier element being adapted to receive at least a portion of said at least one electrode of said at least two light sources; and a connector housing having:

a front face;

first and second port each adapted to receive at least a portion of a respective connector plug, said connector plugs each having a plurality of terminals disposed thereon, said first port being disposed substantially atop said second port; and at least one recess adapted to receive at least a portion of said at least one sub-assembly;

whereby when said at least one sub-assembly is inserted into said at least one recess via said front face.

14. A connector assembly comprising:

at least one sub-assembly having:

at least two light source means each having at least one means for conducting electrical current; and at least one carrier means, said carrier means being adapted to receive at least a portion of said at least one means for conducting of said at least two light source means; and a means for supporting having:

a front face;

first and second ports each adapted to receive at least a portion of a respective connector plug, said connector plugs each having a plurality of conductive means disposed thereon, said first port being disposed substantially atop said second port; and at least one recess adapted to receive at least a portion of said at least one sub-assembly;

whereby when said at least one sub-assembly is inserted into said at least one recess via said front face.

15. A modular connector assembly, comprising:

means for housing a plurality of components, said means for housing having a modular plug port and a first recess, both formed substantially in a front face thereof;

a signal path between said port and an external device to which said connector assembly is adapted to electrically interface with;

two means for generating light; and means for aggregating said two means for generating light into a substantially unitary assembly;

wherein at least a portion of said substantially unitary assembly is received within said first recess primarily via said front face.

16. An electrical connector assembly, comprising:

a housing having a front face, said housing further comprising;

a plurality of modular jack ports formed at least partly within said front face, said ports each being adapted to receive a modular jack having a plurality of terminals;

first recesses disposed on both ends of said housing at least partly in said front face and proximate to respective ones of said ports, said first recesses adapted to each receive, at least partly via said front face, a light source therein; and a plurality of second recesses disposed at least partly in said front face and substantially between adjacent ones of said plurality of ports, said second recesses adapted to receive a plurality of light sources therein;

first light sources with electrodes adapted for receipt within corresponding ones of said first recesses, said electrodes being adapted for mating with an external device;

first carriers adapted to be received within respective ones of said first recesses, said first carriers cooperating with said electrodes of respective ones of said first light sources to maintain said carriers and corresponding ones said first electrodes in a fixed relationship;

a plurality of sets of second light sources with electrodes, said sets each being received with respective ones of said plurality of second recesses, said electrodes being adapted for mating with said external device; and a plurality of second carriers adapted to be received within respective ones of said plurality of second recesses, said second carriers cooperating with said electrodes of respective ones of said sets of second light sources to maintain said carriers and corresponding ones of said sets of second electrodes in a fixed relationship.

17. The connector assembly of claim 16, wherein said first and second light sources comprise LEDs having a viewing surface, each of said LEDs having two of said electrodes, said viewing surface of each of said LEDs being viewable from said front face when installed in said first and second recesses.

18. The connector assembly of claims 16, wherein said electrodes of said first and second light sources are disposed in substantially parallel vertical orientation within respective ones of said carriers.

19. The connector assembly of claim 18, wherein said first carriers each receive the electrodes of one light source, and said second carriers each receive the electrodes of two light sources.

20. The connector assembly of claim 17, wherein said sets of second light sources comprise two LEDs, the viewing surfaces of said two bEDs being juxtaposed with each other, and the electrodes of both sdid two LEDS being at least partly received within a single one of said second carriers.

* * * * *

UNITED STATES PATENT AND TRADEMARK OFFICE

CERTIFICATE OF CORRECTION

PATENT NO. : 6,773,298 B2 
DATED : August 10, 2004
INVENTOR(S) : Aurelio J. Gutierrez and Tsou Zheng Rong It is certified that error appears in the above-identified patent and that said Letters Patent is hereby corrected as shown below:

Column 15,
Lines 62-64, "a first recess adapt to receive at least a portion of a modular plug, said modular plug having a plurality of terminals disposed therein;" should read -- a first recess adapted to receive at least a portion of a modular plug, said modular plug having a plurality of terminals disposed thereon; --

Column 16,
Lines 25-29, "The connector assembly of claim 1, further comprising at least one electronic component dispqsed within at least one of said electrical pathways, said electrical component adapted to condition electrical signals flowing through said at least one pathway." should read -- The connector assembly of claim 1, further comprising at least one electronic component disposed within at least one of said electrical pathways, said electrical component adapted to condition electrical signals flowing through said at least one pathway. --
Lines 30-34, "The connec tor assembly of claim 1, wherein said external device comprises a printed circuit board (PCB), and said electrical mating comprises placing said at least one electrode in electrical communication with corresponding ones of conductive traces of said PCB." should read -- The connector assembly of claim 1, wherein said external device comprises a printed circuit board (PCB), and said electrical mating comprises placing said at least one electrode in electrical communication with corresponding ones of conductive traces of said PCB. --
Lines 36-39, "at least one sub-assembly halving at least one a light source and at least one carrier element, said carrier element being adapted to receive at least a portion of said at least one light source; and" should read -- at least one sub-assembly having at least one a light source and at least one carrier element, said carrier element being adapted to recive at least a portion of said at least one light source; and --
Lines 40-44, "a connector housing having front face and at least one recess formed substantially within said front face, said at least one recess being adapted to receive at least a portion of said at least one sub-assembly via said front face;" should read -- a connector housing having a front face and at least one recess formed substantially within said front face, said at least one recess being adapted to receive at least a portion of said at least one sub-assembly via said front face; --

Column 17,
Lines 6-10, "first and second port each adapted to receive at least a portion of a respective connector plug, said connector plugs each having a plurality of terminals disposed thereon, said first port being disposed substantially atop said second port; and"
should read -- first and second ports each adapted to receive at least a portion of a respective connector plug, said connector plugs each having a plurality of terminals disposed thereon, said first port being disposed substantially atop said second port; and --

UNITED STATES PATENT AND TRADEMARK OFFICE

CERTIFICATE OF CORRECTION

PATENT NO. : 6,773,298 B2 
DATED : August 10, 2004
INVENTOR(S) : Aurelio J. Gutierrez and Tsou Zheng Rong It is certified that error appears in the above-identified patent and that said Letters Patent is hereby corrected as shown below:

Column 18,
Lines 40-43, "The connector assembly of claims 16, wherein said electrodes of said first and second light sources are disposed in substantially parallel vertical orientation within respective ones of said carriers." should read -- The connector assembly of claim 16, wherein said electrodes of said first and second light sources are disposed in substantially parallel vertical orientation within respective ones of said carriers. --
Lines 48-52, "The connector assembly of claim 17, wherein said sets of second light sources comprise two LEDs, the viewing surfaces of said two bEDs being juxtaposed with each other, and the electrodes of both sdid two LEDS being at least partly received within a single one of said second carriers." should read -- The connector assembly of claim 17, wherein said sets of second light sources comprise two LEDs, the viewing surfaces of said two LEDs being juxtaposed with each other, and the electrodes of both said two LEDS being at least partly received within a single one of said second carriers --

Signed and Sealed this

Eighth Day of February, 2005

JON W. DUDAS
*Director of the United States Patent and Trademark Office*

UNITED STATES PATENT AND TRADEMARK OFFICE

CERTIFICATE OF CORRECTION

PATENT NO. : 6,773,298 B2
APPLICATION NO. : 10/140422
DATED : August 10, 2004
INVENTOR(S) : Aurelio J. Gutierrez and Tsou Zheng Rong It is certified that error appears in the above-identified patent and that said Letters Patent is hereby corrected as shown below:

Column 15,
Lines 62-64, "a first recess adapt to receive at least a portion of a modular plug, said modular plug having a plurality of terminals disposed therein;" should read -- a first recess adapted to receive at least a portion of a modular plug, said modular plug having a plurality of terminals disposed thereon; --

Column 16,
Lines 25-29, "The connector assembly of claim 1, further comprising at least one electronic component dispqsed within at least one of said electrical pathways, said electrical component adapted to condition electrical signals flowing through said at least one pathway." should read -- The connector assembly of claim 1, further comprising at least one electronic component disposed within at least one of said electrical pathways, said electrical component adapted to condition electrical signals flowing through said at least one pathway. --
Lines 30-34, "The connec tor assembly of claim 1, wherein said external device comprises a printed circuit board (PCB), and said electrical mating comprises placing said at least one electrode in electrical communication with corresponding ones of conductive traces of said PCB." should read -- The connector assembly of claim 1, wherein said external device comprises a printed circuit board (PCB), and said electrical mating comprises placing said at least one electrode in electrical communication with corresponding ones of conductive traces of said PCB. --
Lines 36-39, "at least one sub-assembly halving at least one a light source and at least one carrier element, said carrier element being adapted to receive at least a portion of said at least one light source; and" should read -- at least one sub-assembly having at least one light source and at least one carrier element, said carrier element being adapted to receive at least a portion of said at least one light source; and --
Lines 40-44, "a connector housing having front face and at least one recess formed substantially within said front face, said at least one recess being adapted to receive at least a portion of said at least one sub-assembly via said front face;" should read -- a connector housing having a front face and at least one recess formed substantially within said front face, said at least one recess being adapted to receive at least a portion of said at least one sub-assembly via said front face; --

Column 17,
Lines 6-10, "first and second port each adapted to receive at least a portion of a respective connector plug, said connector plugs each having a plurality of terminals disposed thereon, said first port being disposed substantially atop said second port; and" should read -- first and second ports each adapted to receive at least a portion of a respective connector plug, said connector plugs each having a plurality of terminals disposed thereon, said first port being disposed substantially atop said second port; and --

UNITED STATES PATENT AND TRADEMARK OFFICE

CERTIFICATE OF CORRECTION

PATENT NO. : 6,773,298 B2
APPLICATION NO. : 10/140422
DATED : August 10, 2004
INVENTOR(S) : Aurelio J. Gutierrez and Tsou Zheng Rong It is certified that error appears in the above-identified patent and that said Letters Patent is hereby corrected as shown below:

Column 18,
Lines 40-43, "The connector assembly of claims 16, wherein said electrodes of said first and second light sources are disposed in substantially parallel vertical orientation within respective ones of said carriers." should read -- The connector assembly of claim 16, wherein said electrodes of said first and second light sources are disposed in substantially parallel vertical orientation within respective ones of said carriers. --
Lines 48-52, "The connector assembly of claim 17, wherein said sets of second light sources comprise two LEDs, the viewing surfaces of said two bEDs being juxtaposed with each other, and the electrodes of both sdid two LEDS being at least partly received within a single one of said second carriers." should read -- The connector assembly of claim 17, wherein said sets of second light sources comprise two LEDs, the viewing surfaces of said two LEDs being juxtaposed with each other, and the electrodes of both said two LEDS being at least partly received within a single one of said second carriers --

This certificate supersedes Certificate of Correction issued February 8, 2005.

Signed and Sealed this

Twenty-fourth Day of October, 2006

JON W. DUDAS
*Director of the United States Patent and Trademark Office*